US008785195B2

(12) United States Patent
Takeuchi et al.

(10) Patent No.: US 8,785,195 B2
(45) Date of Patent: Jul. 22, 2014

(54) COVERED MICRO GEL FIBER

(75) Inventors: Shoji Takeuchi, Tokyo (JP); Hiroaki Onoe, Tokyo (JP); Yukiko Matsunaga, Tokyo (JP); Daisuke Kiriya, Berkeley, CA (US); Riho Gojo, Tokyo (JP); Midori Negishi, Tokyo (JP)

(73) Assignee: The University of Tokyo, Tokyo (JP)

( * ) Notice: Subject to any disclaimer, the term of this patent is extended or adjusted under 35 U.S.C. 154(b) by 17 days.

(21) Appl. No.: 13/501,634

(22) PCT Filed: Oct. 12, 2010

(86) PCT No.: PCT/JP2010/067852

§ 371 (c)(1),
(2), (4) Date: Aug. 8, 2012

(87) PCT Pub. No.: WO2011/046105

PCT Pub. Date: Apr. 21, 2011

(65) Prior Publication Data

US 2012/0301963 A1 Nov. 29, 2012

(30) Foreign Application Priority Data

Oct. 14, 2009 (JP) ..... 2009-237087
Jun. 24, 2010 (JP) ..... 2010-143411

(51) Int. Cl.
*A61K 38/00* (2006.01)

(52) U.S. Cl.
USPC ..... 435/384; 435/41; 435/382; 442/340; 524/916

(58) Field of Classification Search
CPC ..... A61L 27/3895; A61L 27/52; A61L 2300/608; A61K 9/0024; A61K 38/18; A61K 9/0019
USPC ..... 435/382, 41; 442/340; 524/916
See application file for complete search history.

(56) References Cited

U.S. PATENT DOCUMENTS

2006/0188487 A1 8/2006 Thomas et al.
2007/0225631 A1* 9/2007 Bowlin et al. ..... 602/52
2010/0279955 A1 11/2010 Miyachi et al.

FOREIGN PATENT DOCUMENTS

JP 06-015163 1/1994
JP 2008-531769 8/2008
JP 2008-221370 9/2008
WO 2006/091706 8/2006
WO 2009/005152 1/2009

OTHER PUBLICATIONS

Then, K.Y. et al. A New Technique for Mechanically Characterising Hydrogels for Tissue Engineering Cornea. Investigative Ophthalmology & Visual Science, 2005. vol. 46. p. 2185.*
Henmi, Chizuka et al. Development of an Effective 3-D Fabrication Technique Using Inkjet Technology for Tissue Model Samples. Proc. 6th World Congress on Alternative & Animal Use in the Life Sciences, 2007. AATEX 14, Special Issue, pp. 689-692.*
Takei, Takayuki. Novel Technique to Control Inner & Outer Diameter of Calcium-Alginate Hydrogel Hollow Microfibers & Immobilization of Mammalian Cells. Biochemical Engineering Journal, Elsevier, 2010. vol. 49. pp. 143-147.*
Bosnakovski, Darko. Chondrogenic Differentiation of Bovine MSC in Different Hydrogels: Influence of Collagen Type II Extracellular Matrix on MSC Chondrogenesis. Wiley InterScience. 2006. pp. 1152-1163.*
Sugimoto, S. Implantable Hydrogel Microfiber Encapsulating Pancreatic Beta-cells for Diabetes Treatment. 15th International Conference on Miniaturized Systems for Chemistry and Life Sciences. Oct. 2011. pp. 1248-1250.*
Lee, Kwang et al. Synthesis of Cell-Laden Alginate Hollow Fibers Using Microfluidic Chips and Microvascularized Tissue-Engineering Applications. Wiley InterScience. Small vol. 5 No. 11. pp. 1264-1268. Published Online: Mar. 19, 2009.*
Dictionary.com. "Fiber". Downloaded from the dictionary.com website on Nov. 27, 2013.*
International Preliminary Report on Patentability for International Application No. PCT/JP2010/067852, mail date is Apr. 26, 2012.
English Translation of International Preliminary Report on Patentability for International Application No. PCT/JP2010/067852, mail date is May 24, 2012.
Tan et al., "Monodisperse Alginate Hydrogel Microbeads for Cell Encapsulation," Advanced Materials, vol. 19, 2007, pp. 2696-2701.
Tan et al., "Dynamic microarray system with gentle retrieval mechanism for cell-encapsulating hydrogel beads", Lab on a Chip, vol. 8, 2008, pp. 259-266.
Jeong et al., "Hydrodynamic microfabrication via "on the fly" photopolymerization of microscale fibers and tubes", Lab on a Chip, vol. 4, 2004, pp. 576-580.
Shin et al., "On the Fly" Continuous Generation of Alginate Fibers Using a Microfluidic Device, Langmuir, vol. 23, 2007, pp. 9104-9108.
Sugiura et al., "Tubular gel fabrication and cell encapsulation in laminar flow stream formed by microfabricated nozzle array", Lab on a Chip, vol. 8, 2008, pp. 1255.
Search report from International Application No. PCT/JP2010/067852, mail date is Jan. 18, 2011.

* cited by examiner

*Primary Examiner* — Susan Hanley
*Assistant Examiner* — Nghi Nguyen
(74) *Attorney, Agent, or Firm* — Greenblum & Bernstein, P.L.C.

(57) ABSTRACT

A microfiber showing improved mechanical strength, which comprises a micro gel fiber consisting of collagen gel or the like covered with high strength hydrogel such as alginate gel.

10 Claims, 19 Drawing Sheets

COVERED MICRO GEL FIBER

TECHNICAL FIELD

The present invention relates to a micro gel fiber covered with alginate gel or the like.

BACKGROUND ART

Microbeads utilizing hydrogel (Advanced Materials, 19, pp. 2696, 2007; Lab on a Chip, 8, pp. 259, 2008) and microfibers utilizing the same (Lab on a Chip, 4, pp. 576, 2004; Langmuir, 23, pp. 9104, 2007; Lab on a Chip, 8, pp. 1255, 2008) have been focused because of their applicability to researches on cells and proteins. In particular, microfibers utilizing hydrogel as a base material are useful for construction of biochemical sensors (Lab on a Chip, 4, pp. 576, 2004) and artificial tissues (Langmuir, 23, pp. 9104, 2007; Lab on a Chip, 8, pp. 1255, 2008), and are expected to be useful to construct a woven fabric structure and thereby produce a complicated three-dimensional structure having a large area.

Among microfibers comprising hydrogel, microfibers comprising alginate gel as a base material have sufficient mechanical strength. However, microfibers prepared from other hydrogel materials (for example, microfibers comprising peptide hydrogel) have a problem that they are weak in mechanical strength, and cannot be used for producing woven fabrics having a microstructure. From such points of view, means for improving strength of microfibers, those utilizing hydrogels other than alginate gel as a base material, has been highly desired.

PRIOR ART REFERENCES

Non-Patent Documents

Non-patent document 1: Advanced Materials, 19, pp. 2696, 2007
Non-patent document 2: Lab on a Chip, 8, pp. 259, 2008
Non-patent document 3: Lab on a Chip, 4, pp. 576, 2004
Non-patent document 4; Langmuir, 23, pp. 9104, 2007
Non-patent document 5; Lab on a Chip, 8, pp. 1255, 2008

SUMMARY OF THE INVENTION

Object to be Achieved by the Invention

An object of the present invention is to provide a micro gel fiber having improved mechanical strength.

Means for Achieving the Object

The inventors of the present invention conducted various researches to achieve the aforementioned object, and as a result, found that when a microfiber utilizing hydrogel as a base material was covered with alginate gel, mechanical strength of the resulting microfiber having a core-shell structure was remarkably increased, and by using the coated microfiber obtained as described above, a three-dimensional structure of a woven fabric structure, a cylinder structure or the like were successfully constructed. The present invention was accomplished on the basis of the aforementioned findings.

The present invention thus provides a microfiber comprising a micro gel fiber covered with a high strength hydrogel.

As preferred embodiments of the present invention, there are provided the aforementioned microfiber, wherein the high strength hydrogel is alginate gel or agarose gel; the aforementioned microfiber, wherein the micro gel fiber is a fiber comprising a hydrogel as a base material; the aforementioned microfiber, wherein the micro gel fiber is a fiber comprising a hydrogel selected from the group consisting of chitosan gel, collagen gel, gelatin, peptide gel, fibrin gel, and a mixture thereof as a base material; the aforementioned microfiber, wherein the hydrogel is collagen gel; and the aforementioned microfiber, wherein the micro gel fiber to be covered has an external diameter in the range of from 100 nm to 1,000 μm, and the micro gel fiber covered with the high strength hydrogel has an external diameter in the range of from 200 nm to 2,000 μm.

As more preferred embodiments, the present invention provides the aforementioned microfiber, wherein cells are contained in the micro gel fiber; the aforementioned micro gel fiber, wherein a growth factor is contained in the micro gel fiber; a structure comprising any of the aforementioned micro gel fibers; and the aforementioned three-dimensional structure, which has a woven fabric structure or a helical structure.

Further, the present invention also provides a fiber obtainable by removing, from the microfiber comprising a micro gel fiber covered with high strength hydrogel, either of the cover with the high strength hydrogel or the covered micro gel fiber.

Furthermore, the present invention also provides a structure obtainable by constructing a structure comprising any of the aforementioned microfibers, and then removing either of the cover with the high strength hydrogel or the covered micro gel fiber from the structure.

From another aspect, there is provided a cell fiber obtainable by removing the cover with the high strength hydrogel from the aforementioned microfiber containing cells in the micro gel fiber. Further, there is also provided a method for producing a cell fiber, which comprises: (a) the step of preparing a microfiber comprising a micro gel fiber covered with a high strength hydrogel wherein cells are contained in the micro gel fiber; (b) the step of culturing the microfiber to obtain a microfiber containing cell culture in the micro gel fiber; and (c) the step of removing the high strength hydrogel from the microfiber obtained in the step (c) mentioned above. The micro gel fiber preferably consists of collagen gel, and the high strength hydrogel is preferably alginate gel.

The present invention further provides a cellular structure obtainable by constructing a structure comprising the aforementioned microfiber containing cells in the micro gel fiber, and then removing the cover with the high strength hydrogel. There is also provided a method for preparing a cellular structure, such as a cell sheet or a cell block, which comprises (a) the step of preparing a microfiber comprising a micro gel fiber covered with high strength hydrogel wherein cells are contained in the micro gel fiber; (b) the step of culturing the microfiber to obtain a microfiber containing cell culture in the micro gel fiber; (c) the step of obtaining a two-dimensional or three-dimensional structure by using the microfiber; and (d) the step of removing the high strength hydrogel from the two-dimensional or three-dimensional structure obtained in the step (c) mentioned above. The micro gel fiber preferably consists of collagen gel, and the high strength hydrogel is preferably alginate gel.

Effect of the Invention

The microfiber of the present invention has superior mechanical strength, and can be suitably used for constructing a three-dimensional structure, such as a fabric structure, a cylinder structure, or a tube structure. For example, by constructing a woven fabric structure or a tube structure using the microfiber containing cells in the hydrogel, a cell structure such as a cell sheet or a cell block can be easily prepared.

MODES FOR CARRYING OUT THE INVENTION

Figure 1:
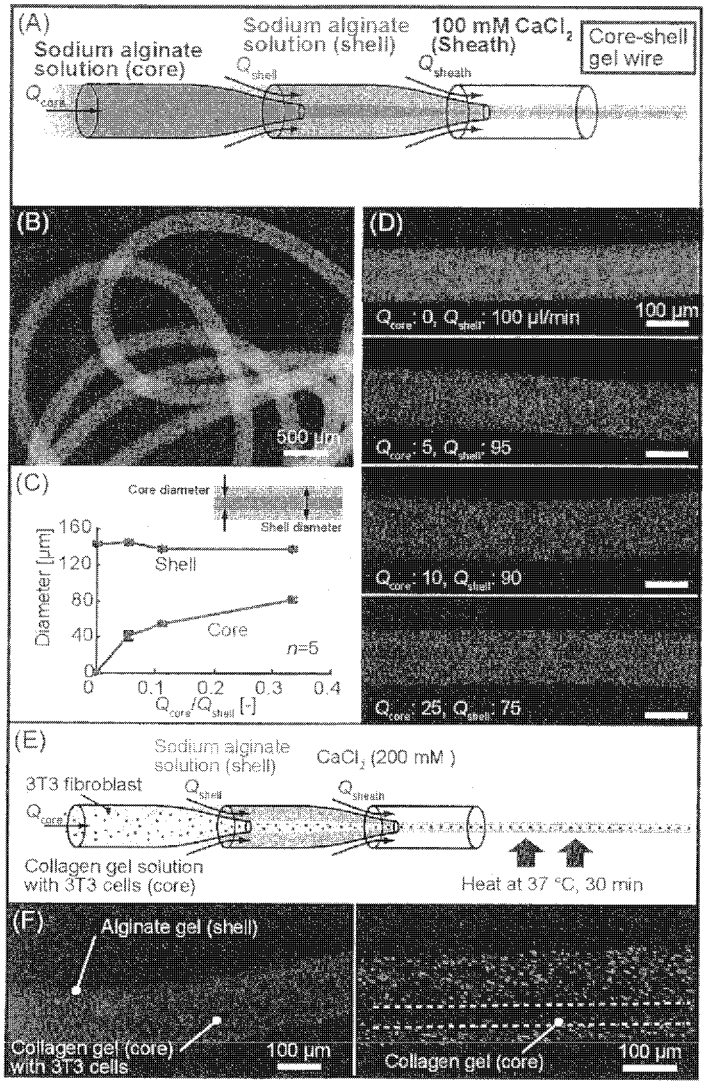
FIG. 1 This figure shows a method for preparing a fiber having a core-shell structure using a double coaxial laminar flow device (Lab. Chip, 4, pp. 576, 2004, FIG. 1). There are shown (A) a conceptual sketch of the method (flow rate: $Q_{core}+Q_{shell}$=100 μl/min, $Q_{sheath}$=3.6 ml/min), and (B) the state of the resulting fiber having a core-shell structure. There is shown in (C) and (D) that the core diameter and covering thickness of the shell are varied depending on the flow rate ratio of the core fluid and the shell fluid ($Q_{core}/Q_{shell}$). There are shown (E) a conceptual sketch of the method for preparing a microfiber having a core-shell structure by using a collagen solution containing 3T3 fibroblasts as the core fluid and a sodium arginate solution as the shell fluid, and (F) the resulting microfiber having a core-shell structure.

The microfiber of the present invention is characterized to comprise a micro gel fiber covered with high strength hydrogel.

The microfiber of the present invention typically has a core-shell structure comprising a core consisting of the micro gel fiber and a shell (coating) containing high strength hydrogel. In the specification, the "micro gel fiber" means a fiber to be covered, and the "microfiber" means a covered fiber.

The microfiber of the present invention encompasses a microfiber in which the micro gel fiber to be covered with the high strength hydrogel is formed as a fiber having a core-shell structure of two different kinds of gels, and a microfiber having a further higher multi-layer structure. Furthermore, the cover of the high strength hydrogel may also be a cover consisting of a multi-layer cover. For example, two or more layers of the cover may be formed with two or more kinds of high strength hydrogel having different strengths.

The shape of the microfiber means, for example, a fibrous shape having an external diameter of about 10 μm to 1 mm. However, the external diameter is not particularly limited to that in the aforementioned range. The microfiber may have various cross-sectional shapes, for example, a circular shape, an elliptic shape and a polygonal shape such as a quadrilateral shape and a pentagonal shape, and the like. The cross-sectional shape is preferably a circular shape. Although the length of the microfiber is not particularly limited, the length may be about several millimeters to several tens of centimeters. Although the external diameter of the micro gel fiber to be covered is also not particularly limited, the external diameter may be, for example, in the range of about 100 nm to 1,000 μm, preferably in the range of 10 to 500 μm. Although the external diameter of the microfiber after being covered with the high strength hydrogel is also not particularly limited, the diameter may be, for example, in the range of 200 nm to 2,000 μm, preferably in the range of 50 to 1,000 μm.

In the microfiber of the present invention, a hydrogel that can be used as the high strength hydrogel may be a hydrogel having a mechanical strength substantially the same as or higher than, preferably higher than, that of the hydrogel used as the base material of the micro gel fiber to be covered. Although the type of the high strength hydrogel is not particularly limited, it is preferable to use a hydrogel having a mechanical strength substantially the same as or higher than that of hydrogel ordinarily used, for example, collagen gel or polyvinyl alcohol hydrogel. Hydrogel having a mechanical strength higher than that of the ordinarily used hydrogel such as collagen gel or polyvinyl alcohol hydrogel can be more preferably used. Examples of such gel include, for example, alginate gel and agarose gel, however, the gels are not limited to these examples. Further, as the high strength hydrogel, hydrogel can be preferably used which has a property of being gelled in the presence of metal ions such as calcium ions. From such a point of view, alginate gel is preferred. Further, agarose gel or photocurable gel that is cured by UV irradiation or the like can also be used. As for the mechanical strength of the gel, tensile strength, load strength, and the like can be measured by a method of using a tensile tester in water or the like according to the methods well known to those skilled in the art.

As the base material of the micro gel fiber, hydrogel can be preferably used. For example, hydrogel comprising chitosan gel, collagen gel, gelatin, peptide gel, fibrin gel or a mixture of these as a base material can be used, although the type of the hydrogel is not particularly limited. As commercially available products, for example, Matrigel (Nippon Becton Dickinson Co., Ltd.), and the like may be used. Further, hydrogel that can be formed by irradiating a water-soluble polymer such as polyvinyl alcohol, polyethylene oxide or polyvinylpyrrolidone with ultraviolet rays or radiation may also be used. Further, supramolecular hydrogel may also be used as the hydrogel. The supramolecular hydrogel is a non-covalent hydrogel formed from self-assembled monomer molecules, and is specifically explained in, for example, "Supramolecular hydrogel as smart biomaterial", Dojin News, 118, pp. 1-17, 2006.

In the preparation of the micro gel fiber, a hydrophilic organic solvent having a water-miscible property, for example, ethanol, acetone, ethylene glycol, propylene glycol, glycerol, dimethylformamide, and dimethyl sulfoxide, may be added. In order to increase the strength of the hydrogel, an appropriate ingredient or a solvent can also be blended. From such a point of view, for example, it is also possible to add dimethyl sulfoxide as a solvent for the preparation of polyvinyl alcohol hydrogel.

One or more kinds of biogenic substances such as cells, proteins, lipids, saccharides, nucleic acids, and antibodies may be added to the micro gel fiber. The type of the cells is not particularly limited, and examples include, for example, ES cells and iPS cells having pluripotency, various kinds of stem cells having multipotency (hematopoietic stem cells, neural stem cells, mesenchymal stem cells and the like), stem cells having unipotency (liver stem cells, reproduction stem cells and the like), as well as various kinds of differentiated cells, for example, myocytes such as skeletal muscle cells and cardiac muscle cells, nerve cells such as cerebral cortex cells, fibroblasts, epithelium cells, hepatocytes, beta cells of pancreas, skin cells, and the like. The micro gel fiber may contain cell culture obtained by culturing cells in the micro gel fiber. However, the cells and biogenic substances are not limited to those exemplified above. Various kinds of growth factors suitable for culture of the aforementioned cells, maintenance and proliferation of the cells, or functional expression of the cells, for example, epidermal growth factor (EGF), platelet-derived growth factor (PDGF), transforming growth factor (TGF), insulin-like growth factor (IGF), fibroblast growth factor (FGF), nerve growth factor (NGF), and the like, may be added to the micro gel fiber. When a growth factor is used, an appropriate concentration can be chosen according to the type of the growth factor. Further, a non-biogenic substance may be added to the micro gel fiber. For example, it is also possible to add fibers such as carbon nanofibers, inorganic substances such as catalytic substances, beads covered with antibodies, or artifacts such as microchips. Biogenic substances and non-biogenic substances may also be added to the high strength hydrogel constituting a shell, if desired.

Although the method for preparing the microfiber of the present invention is not particularly limited, the microfiber can be conveniently prepared by using, for example, a double coaxial microfluidic device such as that shown in FIG. 1. The double coaxial microfluidic device that can separately and coaxially inject two kinds of fluids as a core and a shell is specifically explained in, for example, Lab Chip, 4, pp. 576-580, 2004, FIG. 1, and for preparation of the microfiber of the present invention, the device described in the aforementioned publication can be preferably used.

FIG. 1, (A) as a conceptual sketch shows a method for preparing a microfiber having a core-shell structure consisting of two kinds of alginate gels as a model experiment. By separately and coaxially injecting sodium arginate solutions for a core and shell before crosslinking to form coaxial fluids of a core-shell state, and introducing the fluids into an aqueous solution containing $CaCl_2$ for gelation of the fluids, a microfiber consisting of two kinds of gels of inner part (core) and outer part (shell as the cover) can be constructed. Although the injection speed is not particularly limited, when a coaxial microfluidic device is used which has a size in that the caliber is about 50 μm to 2 mm, two kinds of solutions can be injected at a speed of about 10 to 500 μm/minute. By controlling the injection speeds of two kinds of solutions, the diameter of the core and the cover thickness of the shell can be appropriately adjusted (FIGS. 1, (C) and (D)). Although the introduction speed into an aqueous solution containing calcium ions is also not particularly limited, the speed may be, for example, about 1 to 10 ml/minute.

Where a collagen solution is used as an inner (core) solution in this method, a microfiber of a core-shell structure having the collagen gel as the core and alginate gel as the shell can be prepared. In this case, when cells such as fibroblasts are added to the collagen solution, a microfiber of a core-shell structure containing fibroblasts in the core can be prepared (FIG. 1, (E)). When a collagen solution is used, by passing the solution through an aqueous solution containing calcium ions and then by heating the collagen solution at about 37° C. for about several minutes to 1 hour, collagen can be gelled. In general, the high strength hydrogel of the shell can be formed first, and then the internal core can be gelled by heating, ultraviolet irradiation, or radiation irradiation. However, when a solution of a water-soluble polymer chain that is crosslinked with calcium ions, such as fibrin monomers, is used for the preparation of the internal core, and a sodium arginate solution is used as the solution of the external shell, gelation of the shell and the core can also be simultaneously performed by contact with calcium ions.

If desired, a fiber with exposed micro gel fiber can also be prepared by removing the high strength hydrogel of the shell from the microfiber of the core-shell structure obtained as described above. For example, by preparing a microfiber of a core-shell structure using alginate gel as a high strength hydrogel and collagen as a base material gel of the micro gel fiber, and then allowing a chelating agent such as EDTA to act on the microfiber at an appropriate concentration to remove calcium ions and thereby remove only the high strength hydrogel, a fiber consisting the collagen gel can be prepared. The aforementioned removing operation may be performed after the microfiber is prepared.

Further, it is also possible to prepare a hollow fiber consisting of high strength gel by removing the hydrogel being the core from the microfiber having a core-shell structure, if desired. For example, after a microfiber having a core-shell structure is prepared by using agarose gel as the high strength hydrogel and alginate gel as a base material gel of the micro gel fiber, the alginate gel of the core can solely be removed by allowing a chelating agent such as EDTA to act on the microfiber at an appropriate concentration to remove calcium ions, and thereby prepare a hollow agarose gel fiber. The aforementioned removal may be performed after the microfiber is molded.

Figure 2:
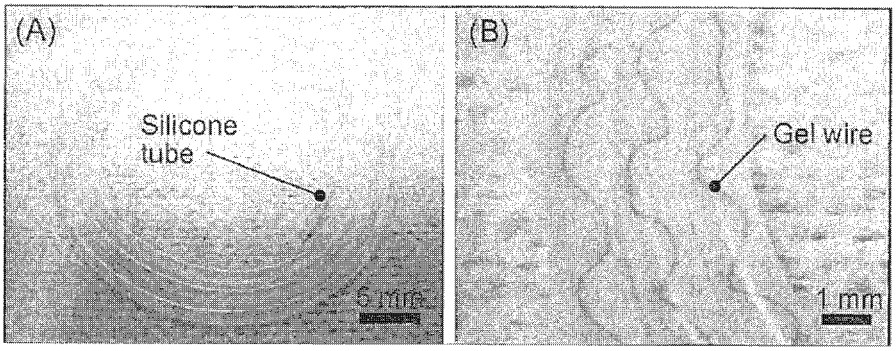
FIG. 2 This figure shows (A) microfibers sucked into a silicone tube, and (B) a magnified view thereof.

The microfiber obtained as described above can be sucked into a silicone tube and stored in a state that the gel is stretched along the longitudinal direction of the tube. It is generally difficult to maintain a gelled microfiber in a linear shape when the gelled microfiber is stored in water, buffer, or the like. However, when the microfiber is put into an aqueous medium such as water and butter, and sucked through a silicone tube having an internal diameter of about 100 μm to several millimeters, of which one end is immersed in the aqueous medium, the microfiber is sucked into the silicone tube from an end thereof in a state that the microfiber is stretched along the longitudinal direction of the tube. This state is shown in FIG. 2. The gel can be stored in this state, and upon use, the silicone tube can be cut in an appropriate length to prepare the gel of a desired length. For the storage, appropriate agents such as preservative, pH modifier and buffering agent can be added to the medium in the tube, as required.

Figure 3:
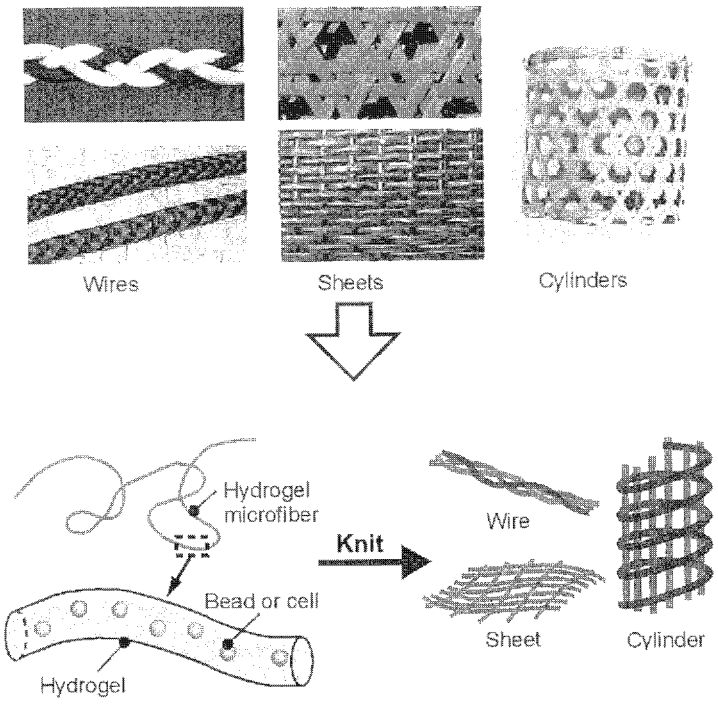
FIG. 3 This figure shows wires (linear structure), sheets (woven fabric structure) and cylinders (cylindrical structure) as examples of a three-dimensional structure that can be constructed by using the microfibers.

The microfiber of the present invention has superior mechanical strength, and can be preferably used for constructing, for example, a braid structure such as double or triple helix braid structure, a woven fabric structure, a three-dimensional structure such as a cylinder structure, a helical structure, and a tube structure. The term "structure" used in this specification means any structure obtainable by molding one microfiber, and any structures that can be constructed with two or more microfibers, and should be construed in the broadest sense thereof including a braid structure having a linear shape in appearance, and a structure such as a sheet that can be seen as a plane in appearance, and these terms should not be construed in any limitative way. In particular, when a three-dimensional structure is intended, the structure may be referred to as a "three-dimensional structure". Conceptual sketches of the three-dimensional structure are shown in FIG. 3.

Further, a plurality of the microfibers of the present invention can also be used as a bundle. For example, a plurality of microfibers containing cells in the micro gel fibers can be prepared, and arranged along the transverse direction as a bundle to from a sheet consisting of the microfibers in lines, and the sheet can be cultured to prepare cell culture in the shape of sheet (referred to as a "cell sheet" in the specification). Further, a plurality of the aforementioned sheets can also be piled up in the shape of a block and cultured to prepare cell culture in the shape of a block (referred to as a "cell block" in the specification).

Figure 4:
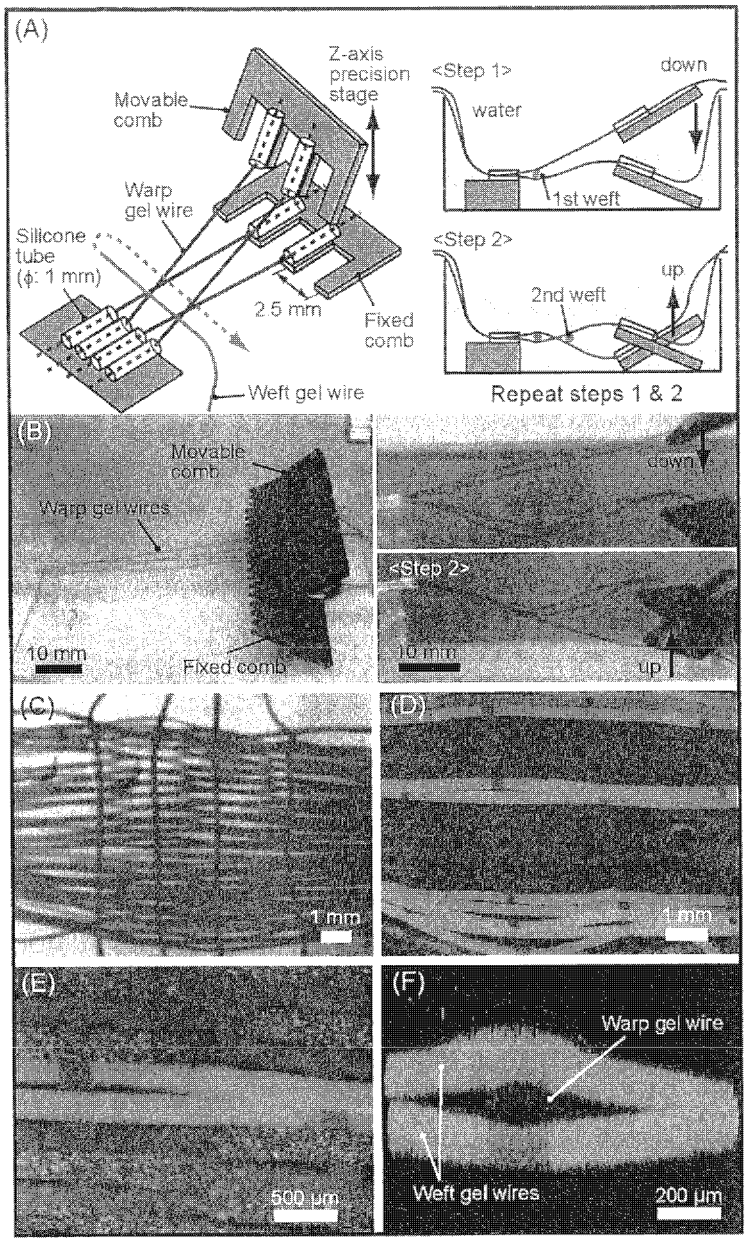
FIG. 4 This figure shows conceptual sketches of a method for preparing a woven fabric structure by using gel in the form of microfiber and a prepared woven fabric structure. There are shown (A) conceptual sketches of the weaving machine (left) and the woven fabric preparation method (right), and (B) a specific example of the method for preparing a woven fabric using gel in the form of microfibers. There are shown (C) the prepared gel having a woven fabric structure, (D) a fluorescent image of the woven fabric, (E) a magnified view of the image of (D), and (F) a cross-sectional view of the sheet. In the drawings, Warp gel wire indicates the gel in the form of microfiber as the warp, and Weft gel wire indicates the microfiber gel as the weft.

For example, in order to prepare a three-dimensional structure having a woven fabric structure, gel having a woven fabric structure can be prepared by using a microweaving machine that provides warp intervals of about 1 to 5 mm and the aforementioned microfibers as warps and/or wefts. Conceptual sketches of this method and examples of the gel having a woven fabric structure are shown in FIG. 4. In the woven fabric structure shown in FIG. 4, (C), the microfiber of the present invention can be used as the warp and the weft, or an alginate microfiber or the like can also be used as the weft or the warp. The alginate microfiber can be prepared by, for example, using a sodium arginate solution as an inner fluid, and a $CaCl_2$ solution as an outer fluid in the aforementioned coaxial micro fluid device. For example, in order to maintain a structure of a two-dimensional structure or a three-dimensional structure including a woven fabric structure and the like, it may be preferable to thinly coat the structure with agarose gel or the like.

The microfiber used as the weft and the warp is preferably set on a weaving machine in such a state that the microfiber is stored in a silicone tube as explained above, so that the microfiber is supplied from the inside of the silicone tube. FIG. 4, (A) includes conceptual sketches showing that the warp is supplied from the inside of the silicone tube.

Figure 5:
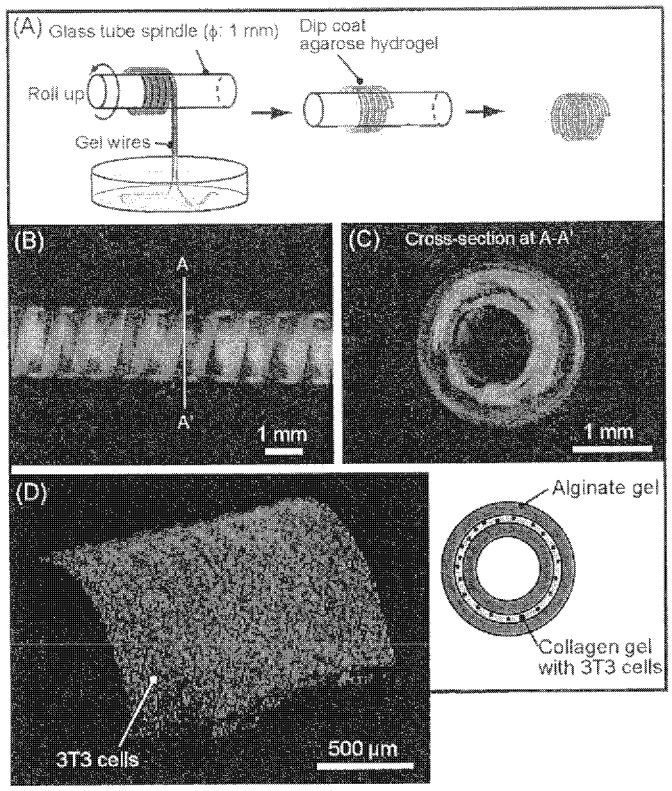
FIG. 5 This figure shows a method for preparing a three-dimensional structure having a helical structure. There are shown (A) a conceptual sketch of the preparation of a helical structure by using two kinds of microfibers, and a method of fabricating a double helical structure comprising two different microfibers by coating the two microfibers rolled up on a glass cylinder having a diameter of 1 mm with agarose by dip coating, and then pulling out the cylinder, (B) a magnified view of the helical structure, and (C) a cross-sectional view of the same. There is shown (D) a confocal image of the surface of the three-dimensional structure having the helical structure prepared by using the microfibers containing 3T3 fibroblasts, and a conceptual sketch of the cross-section thereof is shown on the right side.

Further, in order to prepare a three-dimensional structure having a tube structure, for example, a tubular structure can be formed by rolling up a microfiber using a cylinder such as a glass tube as shown in FIG. 5, (A), coating the outside with agarose gel, alginate gel, or the like, and then pulling out the cylinder. In this method, it is also possible to form a heterogenous tubular structure by using two kinds of different microfibers of the present invention, or it is also possible to form a tubular structure having superior strength by using one microfiber of the present invention and an alginate microfiber for reinforcement. FIG. 5, (A) is a schematic diagram showing operations of rolling up two kinds of different microfibers of the present invention, and fixing the helical structure with agarose.

Furthermore, by constructing an arbitrary structure, preferably a three-dimensional structure, using the microfiber of the present invention, and then removing the high strength hydrogel of the shell to expose the micro gel fiber, as required, a three-dimensional structure constructed with the micro gel fiber can be manufactured. For example, after a three-dimensional structure is constructed by using the microfiber having a core-shell structure using alginate gel as the high strength hydrogel and collagen as a base material gel of the micro gel fiber, by allowing a chelating agent such as EDTA to act on the microfiber at an appropriate concentration to remove calcium ions, and thereby solely remove the high strength hydrogel, a three-dimensional structure constructed with collagen gel can be prepared. The three-dimensional structure of collagen gel obtained as described above can be preferably used for, for example, cell culture.

Alternatively, it is also possible to prepare a three-dimensional structure constructed with a hollow fiber consisting of high strength gel by constructing an arbitrary structure, preferably a three-dimensional structure, using the microfiber of the present invention, and then removing the hydrogel of the core, as required. For example, after a three-dimensional structure is constructed by using the microfiber having a core-shell structure using agarose gel as the high strength hydrogel and alginate gel as a base material gel of the micro gel fiber, by allowing a chelating agent such as EDTA to act on the structure at an appropriate concentration to remove calcium ions, and thereby solely remove the alginate gel of the core, a three-dimensional structure constructed with a hollow agarose gel fiber can be prepared.

By preparing the aforementioned microfiber containing cells in the micro gel fiber, appropriately culturing the microfiber to form cell culture in the micro gel fiber, and then removing the cover of the high strength hydrogel to expose the cell culture, a cell fiber consisting of the cell culture can be obtained. For example, it is preferable to use a collagen gel fiber as the micro gel fiber, and alginate gel as the high strength hydrogel. The cell fiber obtained as described above is a fiber containing cell aggregates in the micro gel fiber, and has a characteristic feature that the fiber can maintain the fiber shape as it is. To the collagen gel of the core containing cells and the alginate gel of the shell, a protein for enhancing adherent property such as fibrin may be added beforehand, as required. The protein may be added only to the core, or the protein can be preferably added to both of the core and the shell. For example, if fibrin is added to both of the core and the shell, cells may uniformly proliferate to form a cell fiber without aggregating to form clusters. The type and amount of the protein to be added are not particularly limited, and appropriately chosen according to the type of the cells to be cultured.

Figure 12:
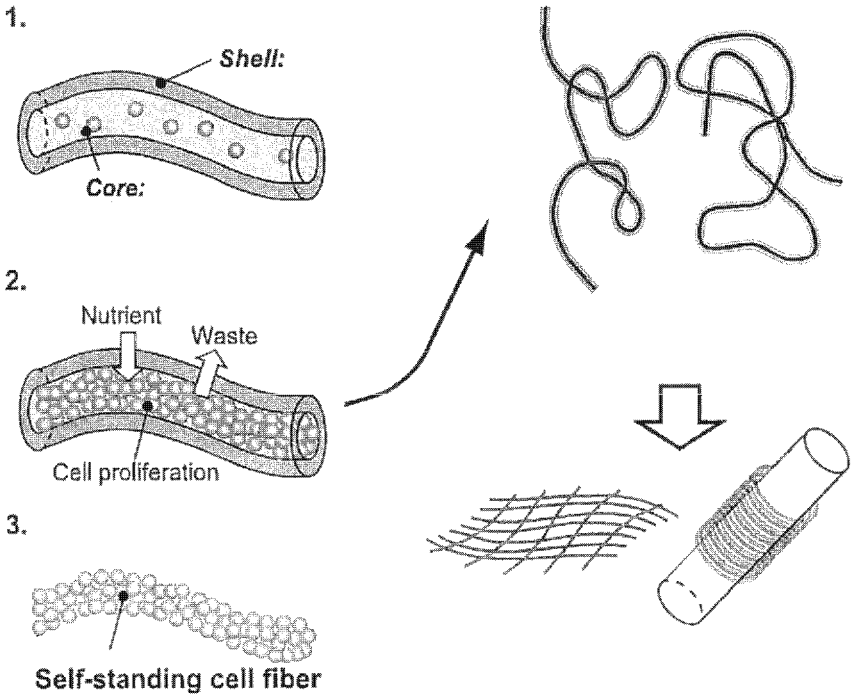
FIG. 12 This figure shows the step of preparing a microfiber (1) consisting of a collagen macro gel fiber containing cells and covered with a high strength hydrogel (arginine), and performing cell culture to prepare a microfiber (2) containing cell culture in the micro gel fiber, and the step of forming the microfiber (2) into a two-dimensional or three-dimensional structure or the step of removing the alginate gel from the microfiber (2) to prepare a cell fiber with exposed cell culture.

Further, after the aforementioned microfiber containing cells in the micro gel fiber is prepared, and appropriately cultured to form cell culture in the micro gel fiber, an arbitrary two-dimensional or three-dimensional structure can be formed by using the resulting microfiber. Alternatively, after the aforementioned microfiber containing cells in the micro gel fiber is prepared, an arbitrary two-dimensional or three-dimensional structure may be formed. Then, by removing the high strength hydrogel from the resulting two-dimensional or three-dimensional structure to expose the cell culture, a two-dimensional cell sheet or a three-dimensional cell block constructed with the aforementioned cell fiber can be manufactured. A conceptual sketch of this method is shown in FIG. 12. After a two-dimensional or three-dimensional structure is formed by using two or more kinds of microfibers containing different cells, respectively, the high strength hydrogel can also be removed, if required. By this method, a two-dimensional cell sheet or a three-dimensional cell block containing two or more kinds of different cell fibers can be formed.

EXAMPLES

The present invention will be more specifically explained with reference to examples. However, the scope of the present invention is not limited to the following examples.

Example 1 (Reference Example)

Figure 6:
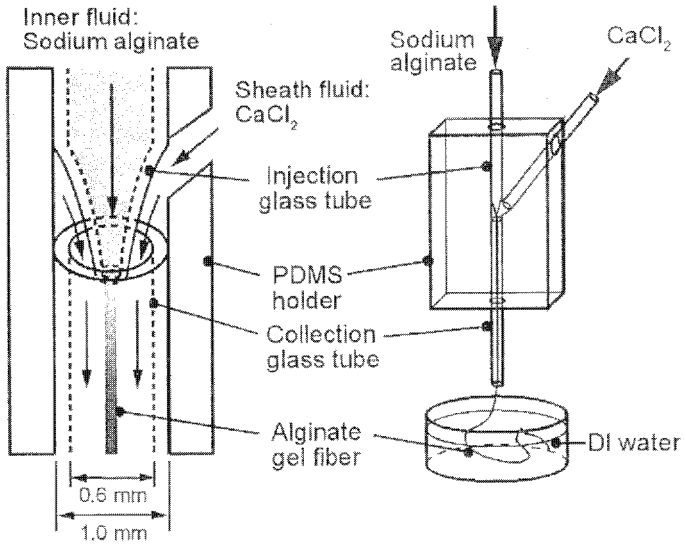
FIG. 6 This figure shows a method for preparing alginate hydrogel fibers as schematic diagrams.
Figure 7:
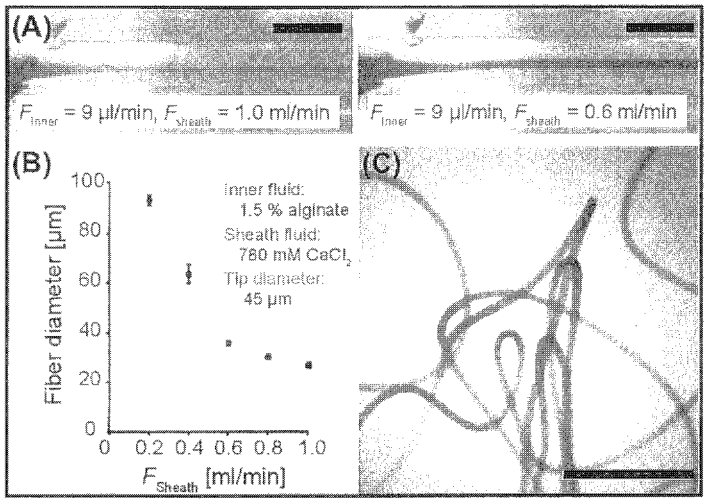
FIG. 7 This figure shows (A) gelation occurs at the merge point of the sodium arginate solution (blue) and the calcium chloride solution, and the diameter of the fiber varies depending on the flow rate of the calcium chloride solution ($Q_{sheath}$). There are shown (B) the relationship between the diameter of the fiber and the flow rate of the calcium chloride solution (fiber diameter is 45 μm), and (C) appearance of the resulting alginate hydrogel fiber. The scale bar shows a length of 500 μm.

An alginate hydrogel fiber was prepared by using a coaxial laminar flow device (Lab. Chip, 4, pp. 576, 2004; Langmuir, 23, pp. 9104, 2007) according to the method shown in FIG. 6, (A). The alginate hydrogel fiber was prepared by using 1.5% w/v sodium arginate (flow rate, $Q_{inner}$=9 μl/min) as the inner fluid and a 780 mM calcium chloride solution ($Q_{sheath}$=0.2 to 1.0 ml/min) as the outer fluid (FIG. 6). Gelation occurred at the merge point of the two kinds of fluids, and the diameter of the resulting fiber was 30 to 95 μm depending on the flow rate of the outer fluid (FIGS. 7, (A) and (B)). The gelled alginate hydrogel fiber was received with a petri dish containing deionized water (FIG. 7, (C)).

Figure 8:
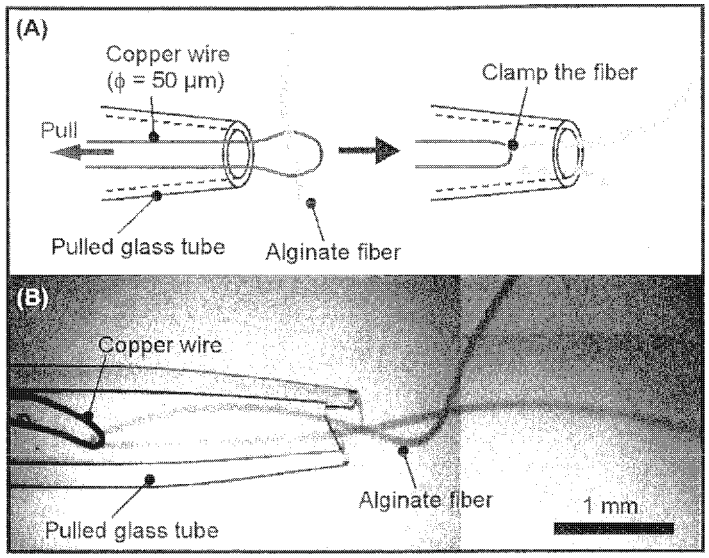
FIG. 8 This figure shows a state that a microfiber is drawn into a glass capillary (internal diameter: 1 mm) by using a copper wire (diameter: 50 μms). There are shown (A) a schematic view of the aforementioned method, and (B) a state that an alginate hydrogel fiber is drawn into a glass tube.
Figure 9:
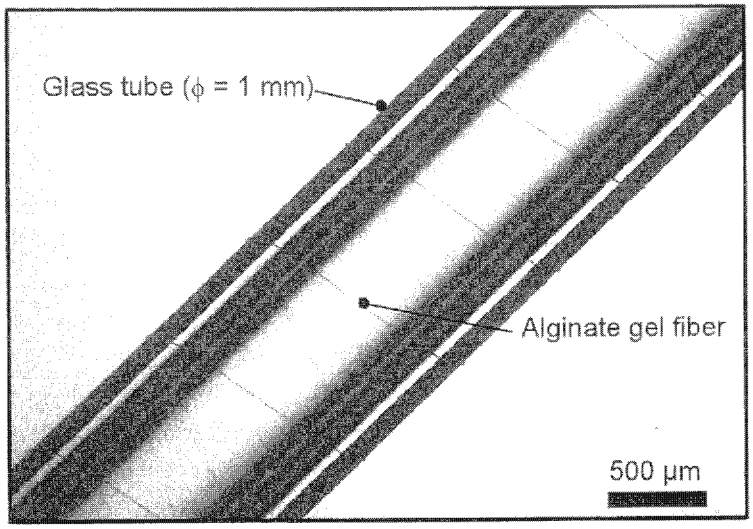
FIG. 9 This figure shows a state that an alginate hydrogel fiber is rolled up by using a glass tube having a diameter of 1 mm.

A copper wire (diameter: 50 μm) was passed through a glass capillary (internal diameter: 1 mm) so that the tip part formed a loop, and the alginate hydrogel fiber was caught with the loop, and drawn into the glass tube. FIG. 8, (A) is a schematic view of the drawing, and FIG. 8, (B) shows the alginate hydrogel fiber drawn into the glass tube as described above. This method enables to firmly hold the end of the hydrogel fiber. The alginate hydrogel fiber had superior mechanical strength, and the fiber was successfully rolled up around a glass tube having a diameter of 1 mm (FIG. 9).

Figure 10:
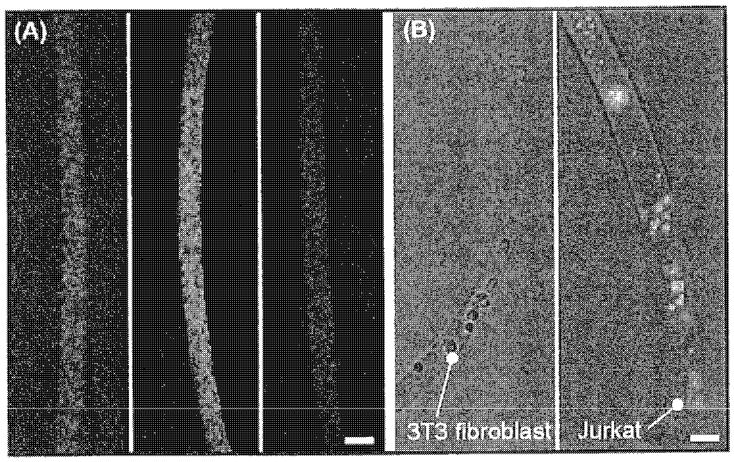
FIG. 10 This figure shows alginate hydrogel fibers (diameter: 70 μm) containing fluorescent microbeads (A) or cells (B) prepared by adding fluorescence microbeads (blue, green and red, diameter: 0.2 to 1.0 μm) or cells (3T3 fibroblasts (red) and Jurkat cells (green)) to an inner fluid.
Figure 11:
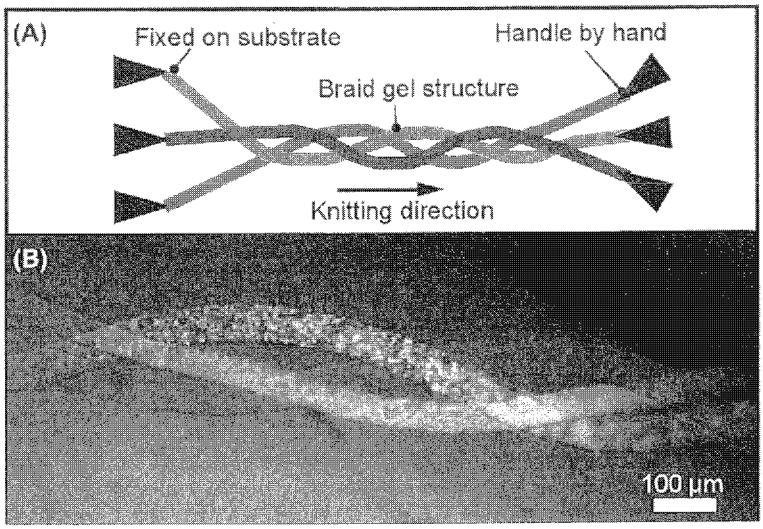
FIG. 11 This figure shows a conceptual sketch of a method for forming a braid structure by hand-knitting using three hydrogel fibers which contain three kinds of beads, respectively (A), and a fluorescence microphotograph of the resulting braid structure (B).

Fluorescent microbeads (blue, green and red, diameter: 0.2 to 1.0 μm) and cells (3T3 fibroblasts (red) and Jurkat cells (green)) were added to the inner fluid, respectively, and alginate hydrogel fibers (diameter: 70 μm) containing fluorescent microbeads (FIG. 10, (A)) or cells (FIG. 10, (B)) were prepared in the same manner as described above. The hydrogel fibers to which those microbeads and cells were added had a mechanical strength of the same level. A braid structure was manually formed by using three hydrogel fibers containing three kinds of the aforementioned beads, respectively. A conceptual sketch of the structure is shown in FIG. 11, (A), and a fluorescence microphotograph of the resulting braid structure is shown in FIG. 11, (B).

Example 2 (Reference Example)

A fiber having a core-shell structure was prepared in the same manner as that of Example 1, except that a double coaxial laminar flow device (Lab. Chip, 4, pp. 576, 2004, FIG. 1) was used. As the fluid for core, 1.5% w/v sodium arginate (colored in orange) was used, as the fluid for shell, 1.5% w/v sodium arginate (colored in green) was used, and as the fluid for sheath, a 780 mM calcium chloride solution ($Q_{sheath}$=3.6 ml/min) was used (FIG. 1, (A)). The resulting fiber having a core-shell structure is shown in FIG. 1, (B). The core diameter and cover thickness of the shell of the resulting fiber were varied depending on the flow rate ratio of the core fluid and the shell fluid ($Q_{core}/Q_{shell}$) (FIGS. 1, (C) and (D)).

Example 3

A microfiber consisting of a collagen micro gel fiber covered with alginate gel as the high strength hydrogel was prepared in the same manner as that of Example 2 by using a collagen solution (concentration: 2 mg/ml) containing the 3T3 fibroblasts (cell number: 1 to $10\times10^6$ cells/ml) as the fluid for core. A conceptual sketch of the method is shown in FIG. 1, (E). The resulting microfiber was a fiber having a core-shell structure in which the collagen gel as the core contained the 3T3 cells and having sufficient mechanical strength (FIG. 1, (F)).

Example 4 (Reference Example)

A three-dimensional structure having a woven fabric structure was prepared by the method shown in FIGS. 4, (A) and (B). By using the alginate hydrogel fibers (diameter: 230 μm) obtained in Example 1 as the warps and wefts, the woven fabric structure shown in FIG. 4, (C) was knitted. In the same manner, a three-dimensional structure having a woven fabric structure was prepared by using the alginate hydrogel fibers of different fluorescence color as a part of the warps and the wefts (FIG. 4, (D)). FIG. 4, (E) is a magnified view, and (F) is a cross-sectional view.

Example 5

In the same manner as that of Example 4, a three-dimensional structure having a woven fabric structure was prepared by using the microfibers obtained in Example 3 (core diameter: 40 μm, external diameter: 140 μm, 3T3 fibroblast density: $10^7$ cells/ml) as the warps and the alginate hydrogel fibers obtained in Example 1 as the wefts.

Example 6

Two kinds of microfibers (microfiber A, core diameter: 40 μm, external diameter: 140 μm, colored with green fluorescence; microfiber B, core diameter: 40 μm, external diameter: 140 μm, colored with orange fluorescence) were rolled up around a glass tube (diameter: 1 mm) in such a state that two kinds of the microfibers were closely arranged without any gap between them as shown in FIG. 5, (A), and the outer surface of the resulting helical structure was coated with agarose gel (3%) to prepare a three-dimensional structure having a helical structure. FIG. 5, (B) is a magnified view of the helical structure, and FIG. 5, (C) is a cross-sectional view thereof.

Example 7

In the same manner as that of Example 6, a microfiber containing the 3T3 fibroblasts (core diameter: 40 μm, external diameter: 140 μm, cell density: $10^7$ cells/ml) was rolled up around a glass tube to prepare a three-dimensional structure having a helical structure. FIG. 5, (D) shows a confocal image of the surface of the resulting helical structure, and a conceptual sketch of the cross-sectional view is shown on the right side thereof.

Example 8

Figure 13:
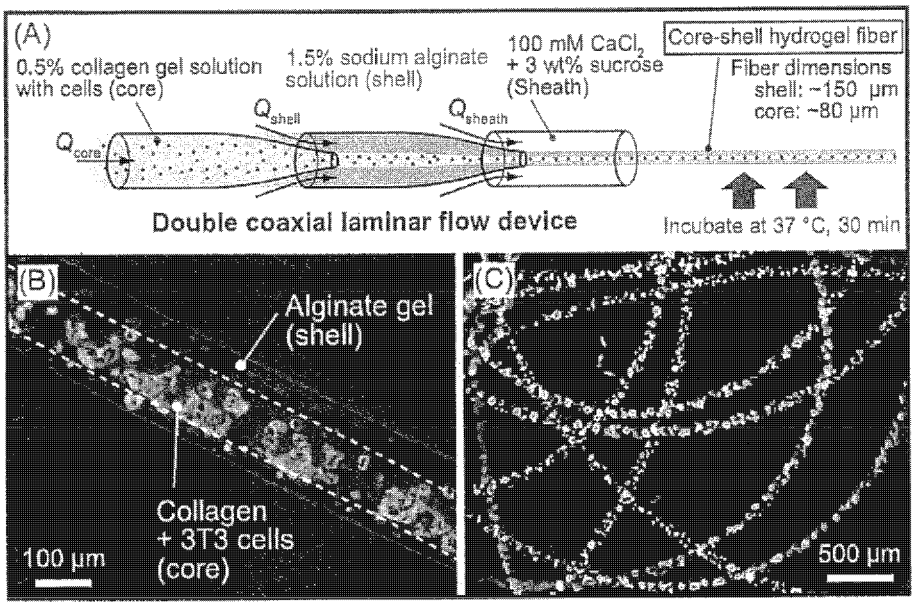
FIG. 13 This figure shows preparation of a microfiber consisting of collagen gel as a core and alginate gel as a shell, and containing 3T3 fibroblasts and polystyrene blue beads for visualization in the core (A), and the results of optical observation of the state of the microfiber after incubation at 37° C. for 30 minutes (B and C).

In the same manner as that of Example 3, a microfiber consisting of collagen gel as the core and alginate gel as the shell, and containing the 3T3 fibroblasts (cell number: 1 to $10\times10^6$ cells/ml) and polystyrene blue beads for visualization (diameter: 15 μm) in the core was prepared (core diameter: 80 μm, external diameter: 150 μm, cell density: $10^7$ cells/ml, bead density: 0.5% (w/v)), and cultured at 37° C. for 30 minutes, and then the appearance of the microfiber was optically observed. It was successfully confirmed that the 3T3 cells and the collagen gel of the core were covered with the alginate gel of the shell (FIG. 13).

Example 9

Figure 14:
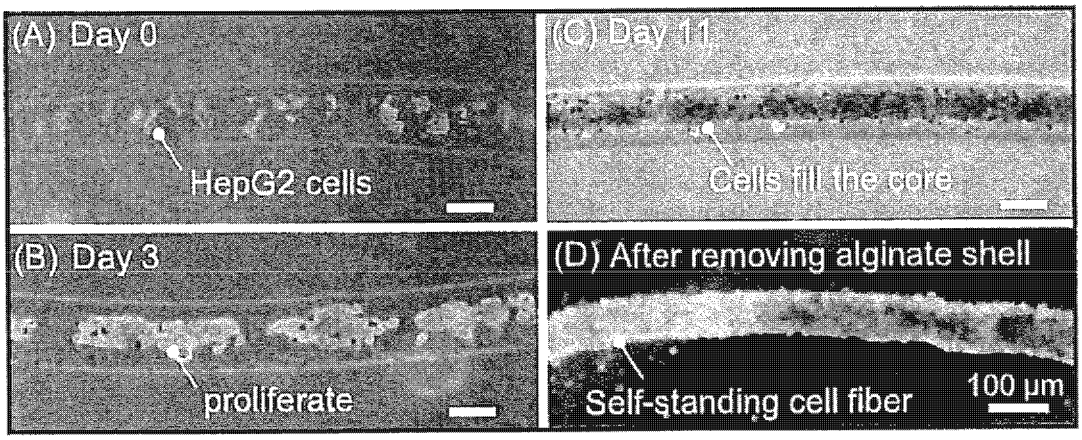
FIG. 14 This figure shows a microfiber containing culture of the HepG2 cells in a core obtained by preparing a microfiber containing the HepG2 cells in the core and incubating the microfiber. There are shown the results of (A) the day 0 of the culture, (B) the day 3 of the culture, (C) the day 11 of the culture, and (D) a state of a cell fiber obtained by removing alginate gel with an enzyme treatment.

A microfiber containing the HepG2 cells in the core was prepared in the same manner as that of Example 3 and cultured to fabricate a microfiber containing culture of the HepG2 cells in the core. As the culture was continued, the core consisting of the collagen gel was filled with the proliferated cells, and a microfiber of which core was fully filled with the cells (microfiber containing collagen gel and cell culture in the core and covered with alginate gel) was obtained on the day 11 (FIGS. 14, (A) to (C)). When the cell culture in the form of a fiber (cell fiber) was exposed from the above microfiber by removing the alginate gel with an enzyme treatment, the shape of the cell fiber was kept as it was, and it was estimated that the cells firmly bound to one another (FIG. 14, (D)).

Figure 15:
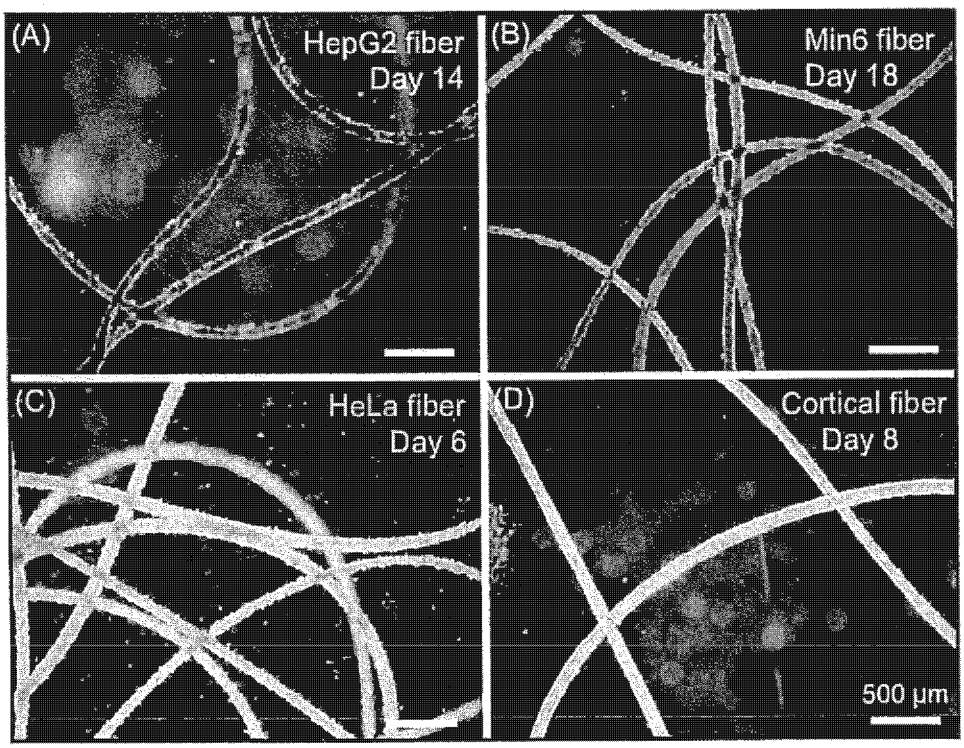
FIG. 15 This figure shows states of cell fibers obtained by fabricating gel fibers containing (A) HepG2 cells (day 14 of culture), (B) Min6 cells (day 18 of culture), (C) Hela cells (day 6 of culture), and (D) primary cerebral cortex cells of the rat brain (day 8 of culture), and then removing the alginate gel of the shell.

In the same manner, gel fibers containing cell culture in the collagen gel of the core were prepared by using the HepG2 cell (culture on day 14), Min6 cells (culture on day 18), Hela cells (culture on day 6), and primary cerebral cortex cells of the rat brain (culture on day 8) (FIGS. 15, (A) to (D)). In the culture of the primary cerebral cortex cells, B-29 and G-5 (Gibco) were added to the core as growth factors at the standard concentrations specified by the manufacturer. Then, the alginate gel of the shell was removed to prepare each cell fiber.

Example 10

Figure 16:
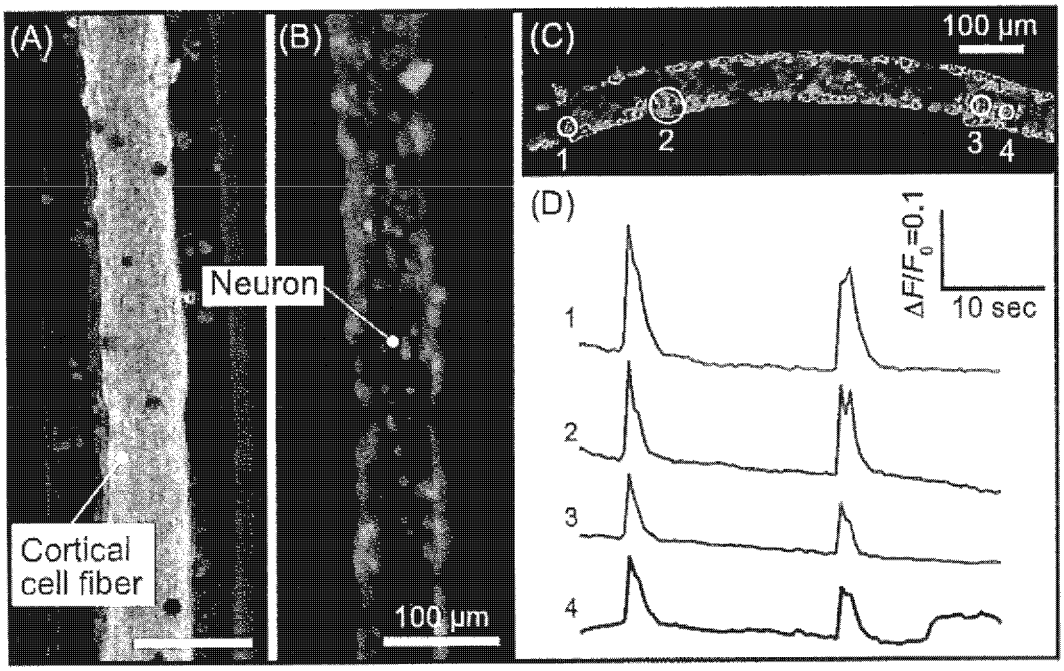
FIG. 16 This figure shows the results of $Ca^{2+}$ imaging of the cell fiber containing primary cerebral cortex cells of the rat brain (day 14). There are shown a phase contrast image of the cell fiber (A), a fluorescent image obtained by using Fluo4-AM as a calcium ion detection reagent (B), and a pseudo color image of the cell fiber obtained with Fluo-4 (C), for which fluorescence intensity (ΔF/F0) was monitored at four points (1 to 4). There is shown that synchronization of the calcium vibration was observed at all the points 1 to 4 (D).
Figure 17:
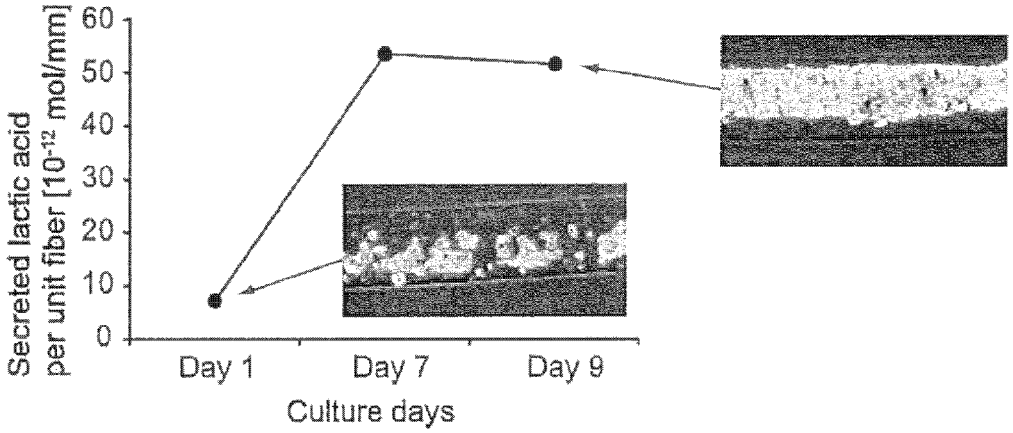
FIG. 17 This figure shows that the cell fiber containing the HepG2 cells secreted lactic acid after culture.

Functions of the cell fiber of the primary cerebral cortex cells derived from the rat brain (culture on day 8) obtained in Example 9 were examined. As a result, spontaneous $Ca^{2+}$ vibration was observed in a large number of cerebral cortex neurons, and it was demonstrated that a nerve network was formed in the cerebral cortex cell fiber (FIG. 16, (D)). Further, it was confirmed that the cell fiber of the HepG2 cells obtained in Example 9 secreted lactic acid when the fiber was cultured (FIG. 17).

Example 11

Figure 18:
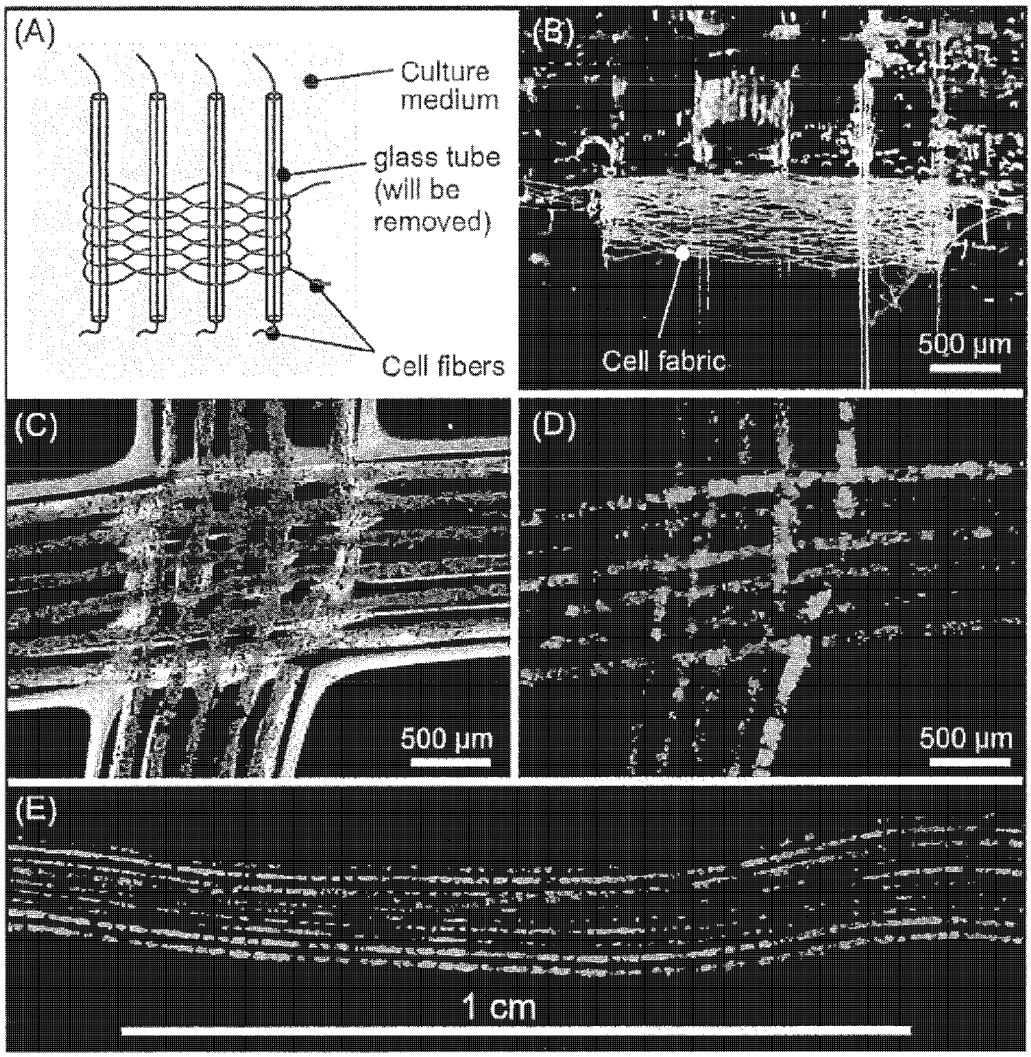
FIG. 18 This figure shows states of a cell sheet fabricated by constructing a cellular structure having a woven fabric structure with gel fibers, consisting of collagen gel containing Hela cell culture as a core and alginate gel as a shell, and then removing the alginate gel. There are shown (A) a conceptual sketch of the fabrication method of the woven fabric structure, and (B) a photograph of the woven fabric structure of the resulting cell sheet. There are shown microscopic images (C: visible light image, and D: fluorescent image) of the cell structure having the woven fabric structure comprising six warps and five wefts, and (E) a cell structure in which cell fibers of about 1.5 cm length were arranged in parallel.

A cell structure having a woven fabric structure was constructed with gel fibers in which cell culture of the Hela cells was contained in collagen gel of the core, and the shell was alginate gel. A conceptual sketch of the method for preparing a cell sheet having a woven fabric structure is shown in FIG. 18, (A). The resulting cell sheet having a woven fabric structure was a cell structure having a size of centimeter order (about 1 to 2 cm) (FIG. 18, (B)). A cell structure having a woven fabric structure consisting of six warps and five wefts is shown in FIG. 18, (C) (visible light image) and FIG. 18, (D) (fluorescence image). Further, a cell structure consisting of the cell fibers having a length of about 1.5 cm and arranged in parallel was fabricated (FIG. 18, (E)).

Example 12

Figure 19:
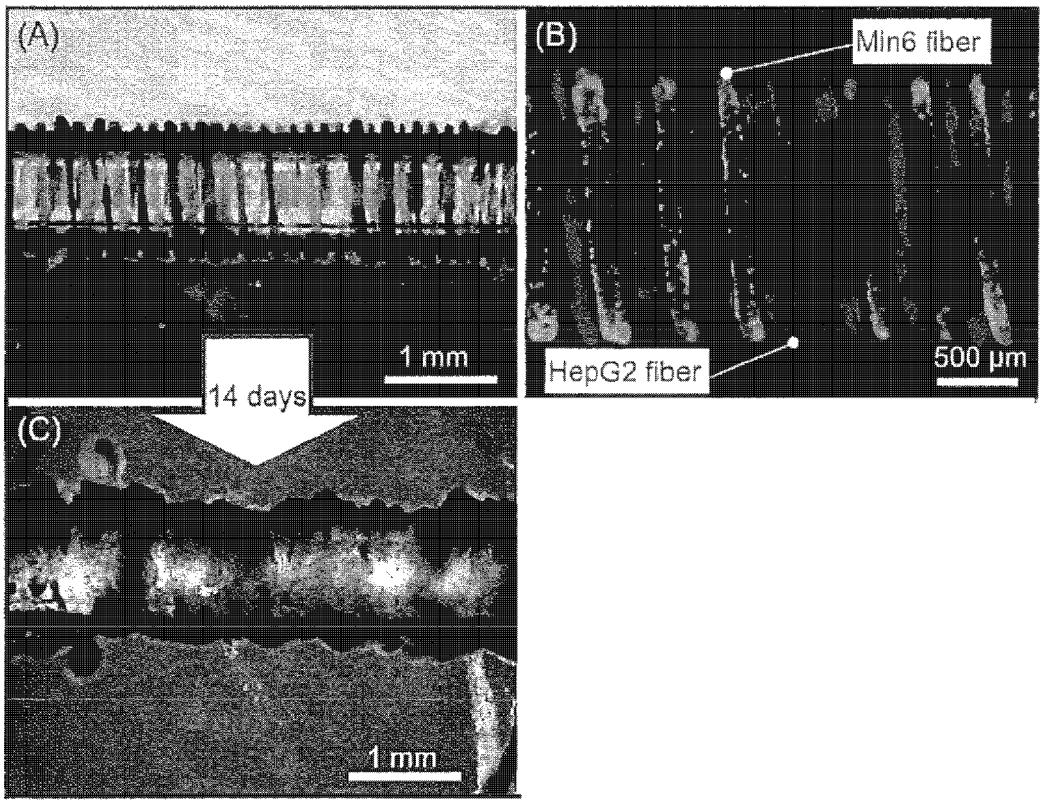
FIG. 19 This figure shows a cell structure having a heterogenous coil structure formed by rolling up two different gel fibers, a gel fiber consisting of collagen gel containing HepG2 cell culture as a core and alginate gel as a shell, and a gel fiber consisting of collagen gel containing Min6 cell culture as a core and alginate gel as a shell, on a glass tube having a diameter of 1 mm. There are shown (A) a visible light image and (B) a fluorescent image. There is also shown that (C) the coil structure was maintained in a state that the structure was embedded in the collagen gel after the alginate gel as the shell was removed and then the culture was continued.

A cell structure having a heterogenous coil structure was formed by using a gel fiber in which cell culture of the HepG2 cells was contained in collagen gel of the core and the shell consisted of alginate gel, and a microfiber in which cell culture of the Min6 cells was contained in collagen gel of the core and the shell consisted of alginate gel (FIG. 19). The cells contained in the resulting cell structure having a coil structure continued to proliferate even after the alginate gel was removed, and thus it was demonstrated that the cells contained in the cell structure maintained biological functions (FIG. 19, (C)).

Example 13

Figure 20:
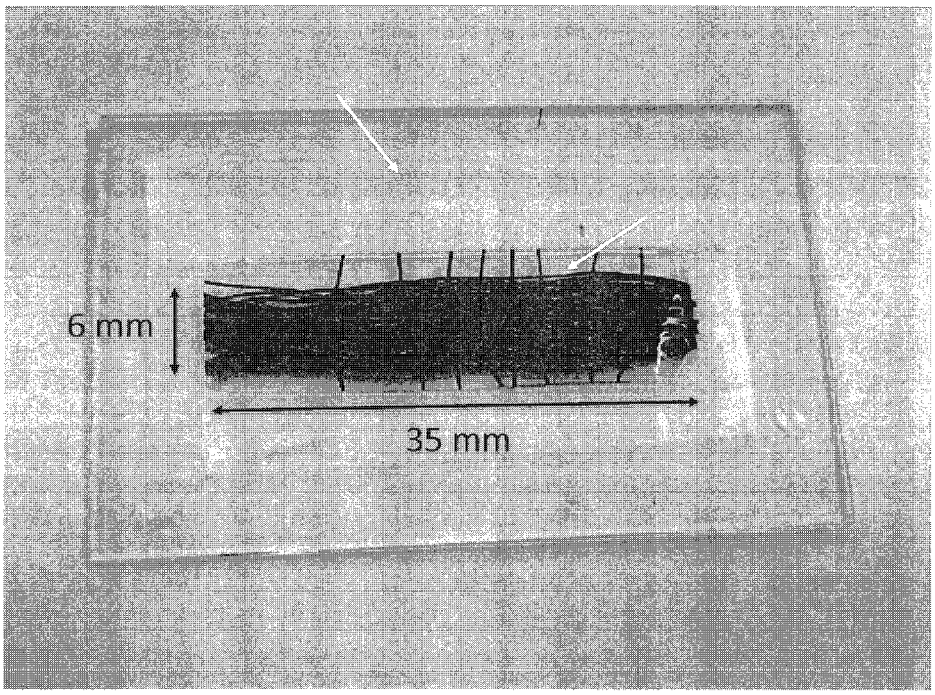
FIG. 20 This figure shows a state of a two-dimensional structure having a woven fabric structure prepared with microfibers consisting of collagen gel fibers (core, containing three kinds of different fluorescent beads) covered with alginate gel (shell), which was thinly covered with agarose gel on a transparent film.
Figure 21:
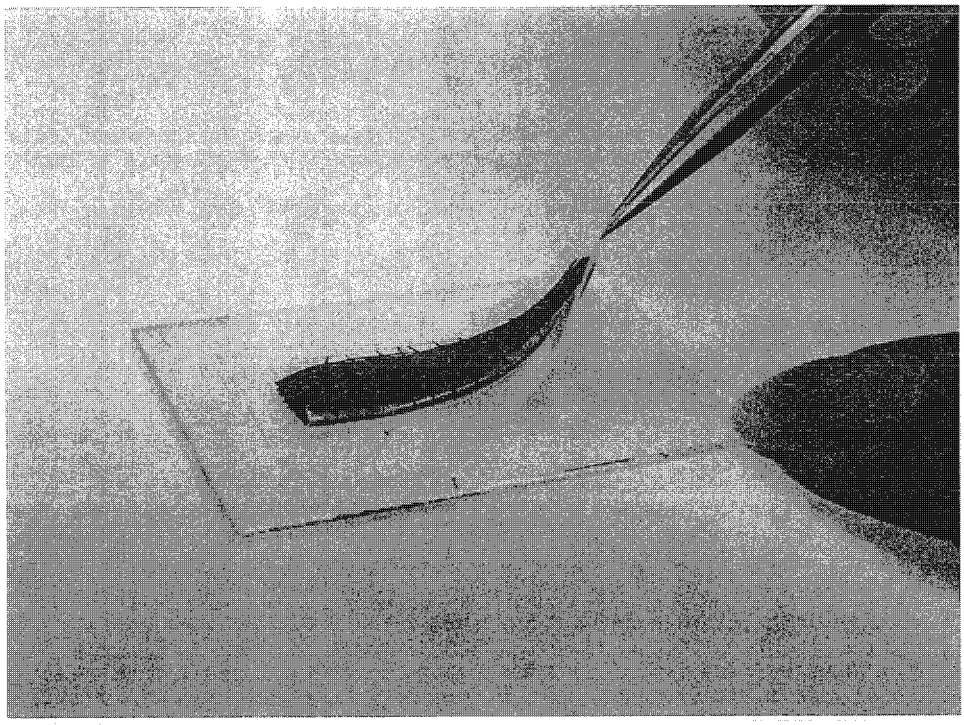
FIG. 21 This figure shows a state of the two-dimensional structure shown in FIG. 20, which was pulled up with a pair of tweezers.
Figure 22:
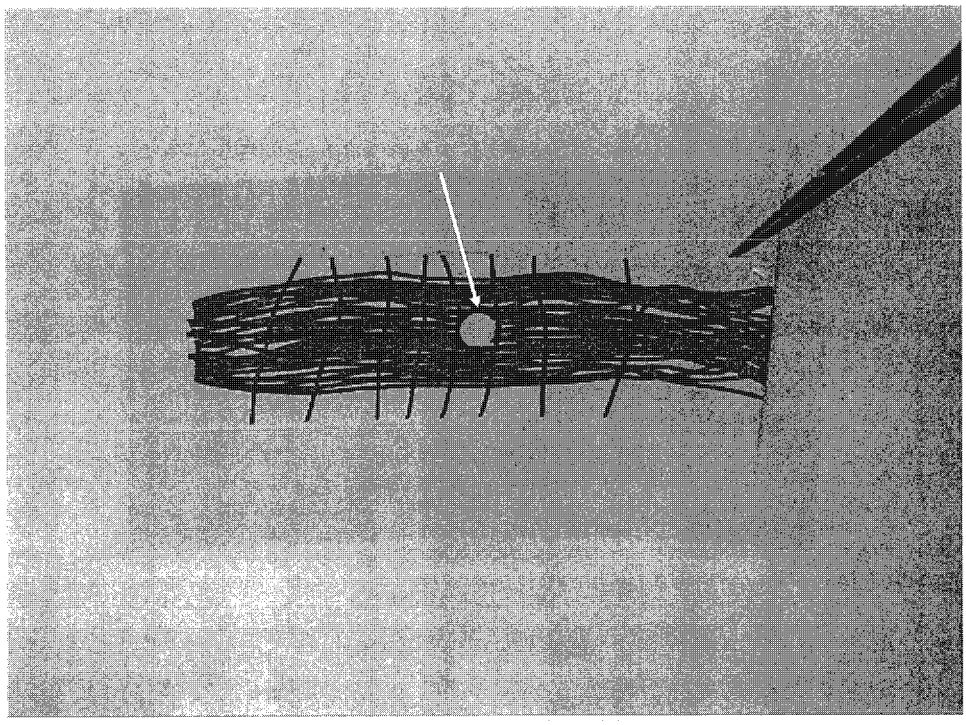
FIG. 22 This figure shows a state of the two-dimensional structure having a woven fabric structure, in which a hole (diameter: 1.5 mm) was made at the center.
Figure 23:
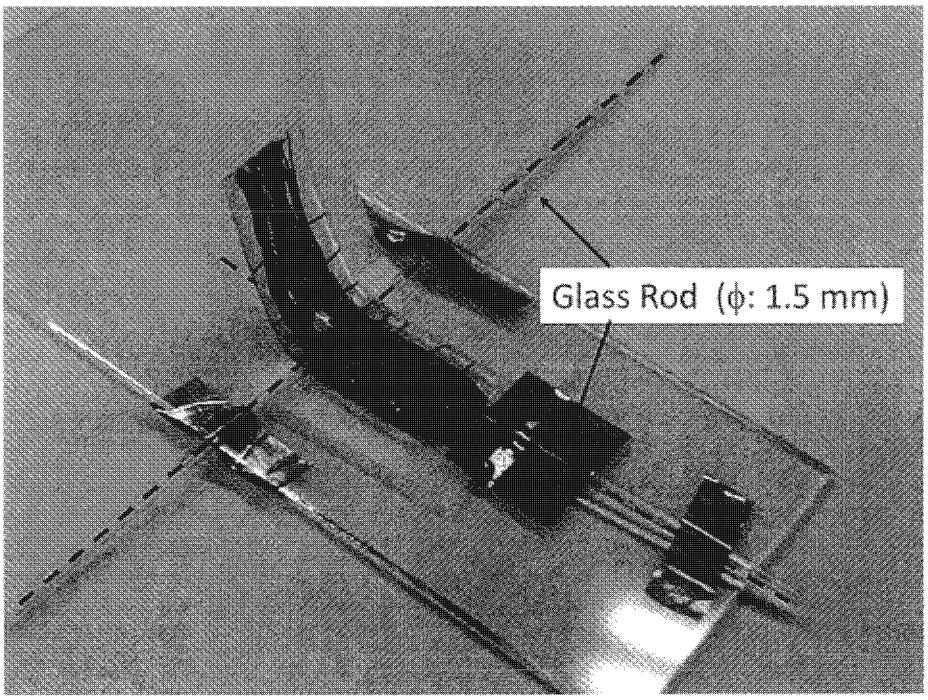
FIG. 23 This figure shows a state of the two-dimensional structure shown in FIG. 22, in which the fabric structure was folded by putting a glass rod through the hole and placing one each of glass rod on the right and the left so that they perpendicularly intersect with the glass rod passing through the hole.
Figure 24:
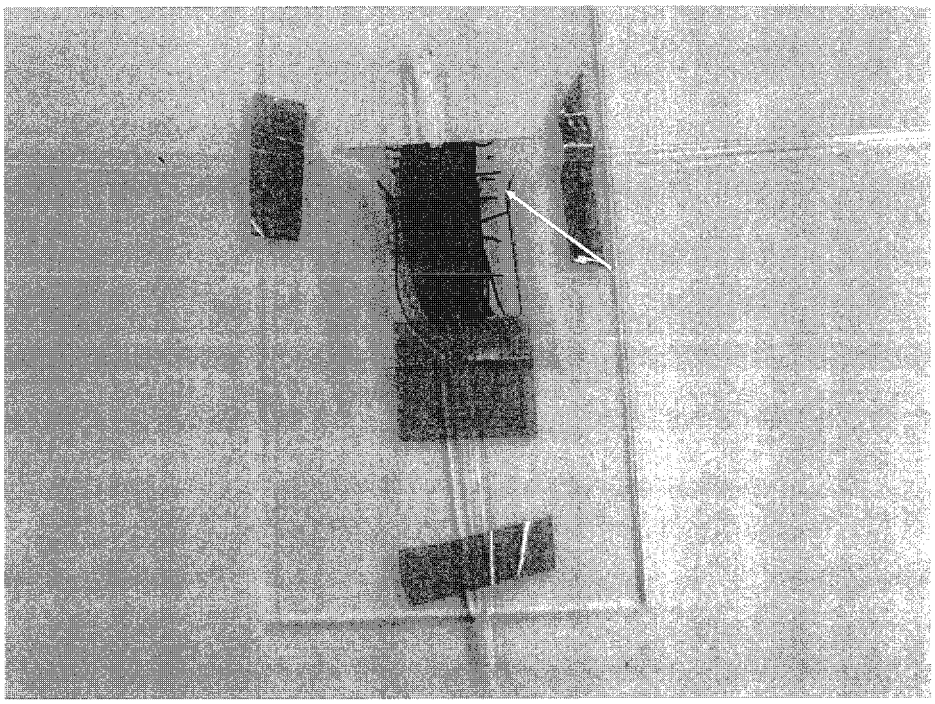
FIG. 24 This figure shows a state of the folded structure, which was fixed with agarose gel.
Figure 25:
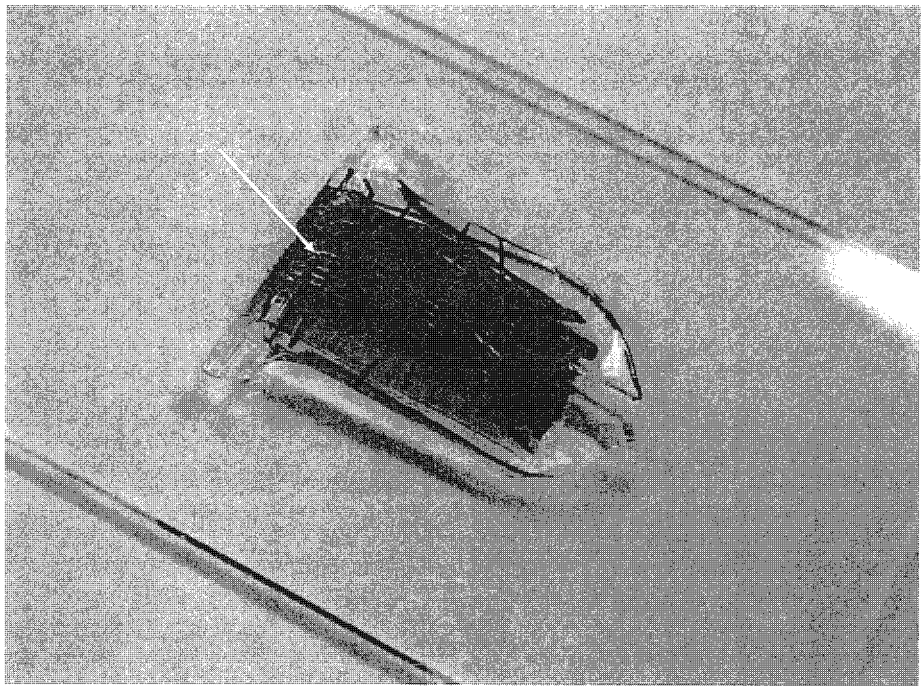
FIG. 25 This figure shows cutting off of the margin with a cutter after the glass rods and the transparent film were removed.
Figure 26:
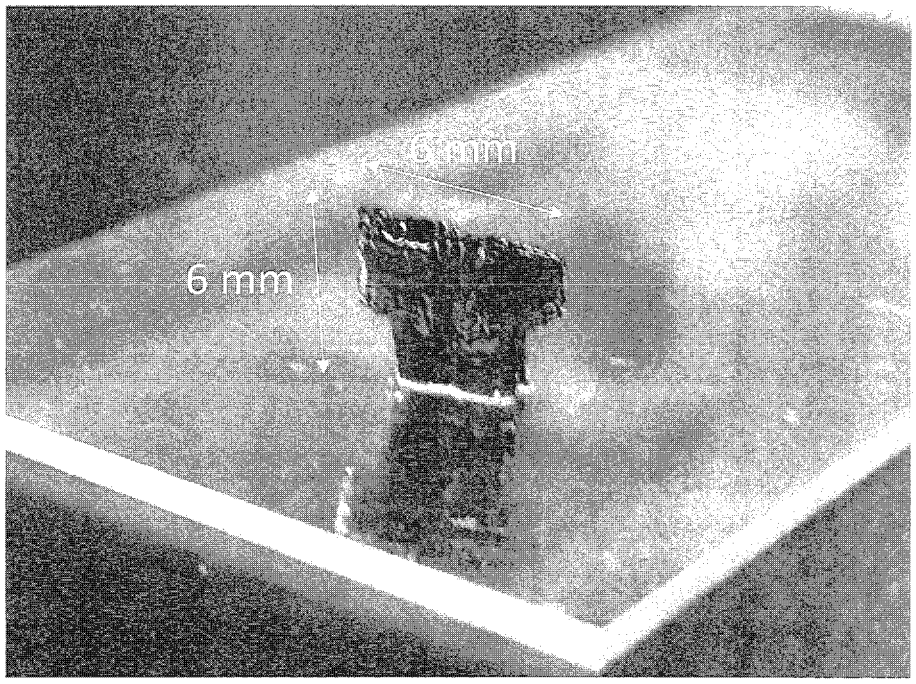
FIG. 26 This figure shows the resulting T-shirt-shaped three-dimensional structure (length: 6 mm×width: 6 mm) in a standing state.
Figure 27:
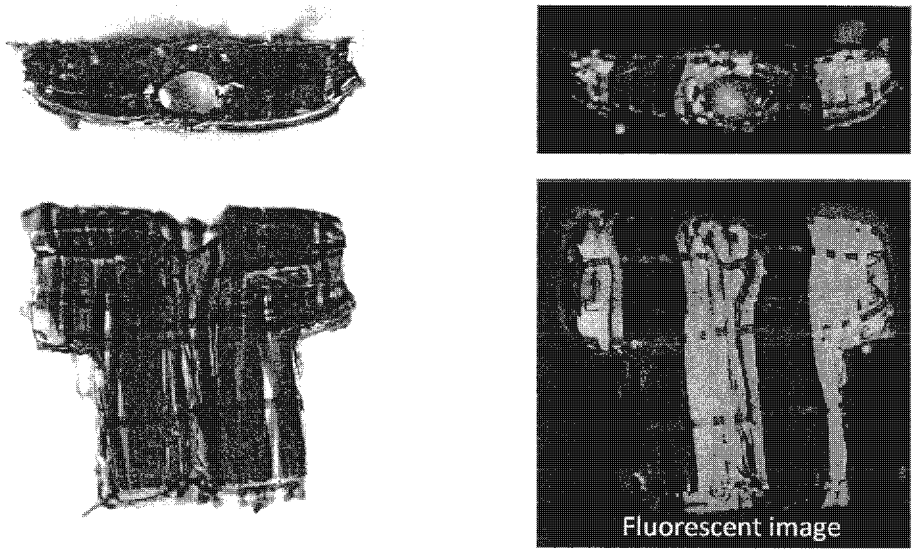
FIG. 27 This figure shows a fluorescent image of the resulting T-shirt-shaped three-dimensional structure. Three kinds of fluorescence emitted by the fluorescent beads were observed.

A two-dimensional structure of a fabric shape was prepared by using microfibers having a core-shell structure in which a collagen gel fiber (core, containing three kinds of different fluorescent beads) was covered with alginate gel (shell), and a T-shirt-shaped three-dimensional structure was fabricated by using the fiber. A two-dimensional structure having a woven fabric shape was fabricated by using the microfibers, placed on a transparent film, and thinly coated with agarose gel in order to maintain the woven fabric structure (FIG. 20). The woven fabric structure coated with agarose had sufficient mechanical strength, and the structure was successfully raised with a pair of tweezers (FIG. 21). A hole (diameter: 1.5 mm) was made at the center of the woven fabric-shaped structure with a punch (FIG. 22), a glass rod having a diameter of 1 mm was passed through the provided hole, one glass rod each was put on the right and left sides so that these glass rods perpendicularly intersected with the foregoing glass rod, and the fabric structure was folded (FIG. 23). After the folding, agarose gel was cast in the gap and gelled to fix the fabric structure in the folded state (FIG. 24). The glass rods and the transparent film were removed, and the excessive margin was cut off with a cutter to prepare a T-shirt-shaped three-dimensional structure (FIG. 25). The resulting three-dimensional structure (length: 6 mm×width: 6 mm) in a standing state is shown in FIG. 26. It can be observed that a three-dimensional structure in the form of T-shirt having holes for head and arms was obtained. FIG. 27 is a fluorescent image of the aforementioned three-dimensional structure. Three kinds of fluorescence originating in the fluorescent beads were observed.

Example 14

Figure 28:
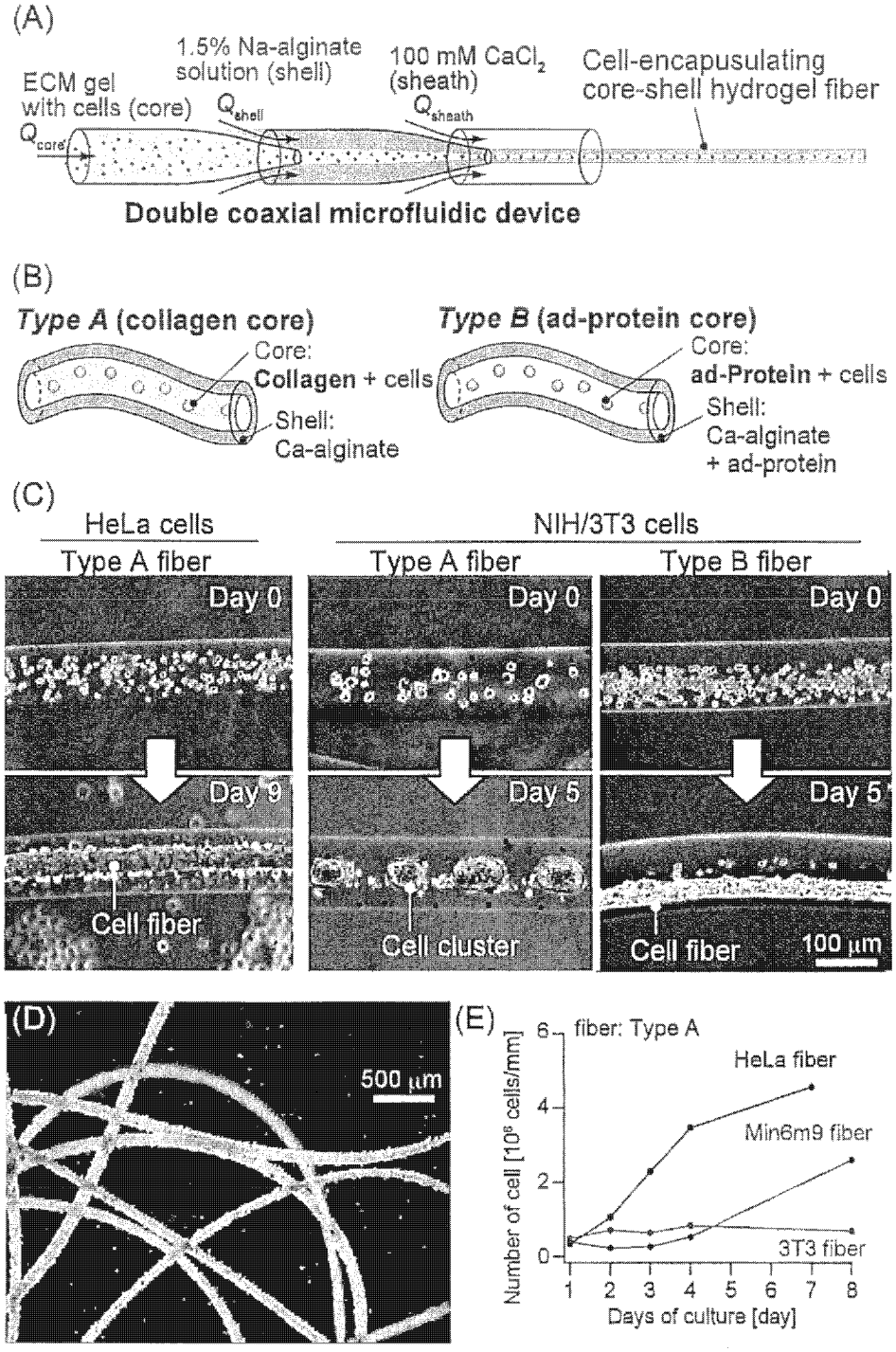
FIG. 28 This figure shows results of cell proliferation in a microfiber in which fibrin was added to collagen gel containing cells (Hela cells or NIH/3T3 cells) as the core and the shell as an adherent protein (ad-protein) (Type B) and a microfiber in which fibrin was not added (Type A).

A microfiber in which fibrin as an adherent protein was added (amount of added fibrinogen: 1 mg/mL) to collagen gel of the core containing cells (Hela cells or NIH/3T3 cells) and alginate gel of the shell (Type B) and a fibrin-free microfiber (Type A) were prepared and cultured. The method and the results are shown in FIG. 28. In the microfiber of Type A, the Hela cells favorably proliferated ((C), left), whereas the 3T3 cells did not proliferate and form cell fiber, but formed cell clusters ((C), center). On the other hand, in the microfiber of Type B to which fibrin was added, favorable proliferation and formation of a cell fiber were observed also for the 3T3 cells ((C), right). In the microfiber of Type A, difference in the proliferation rate was observed depending on the type of the cells ((E)).

Example 15

Figure 29:
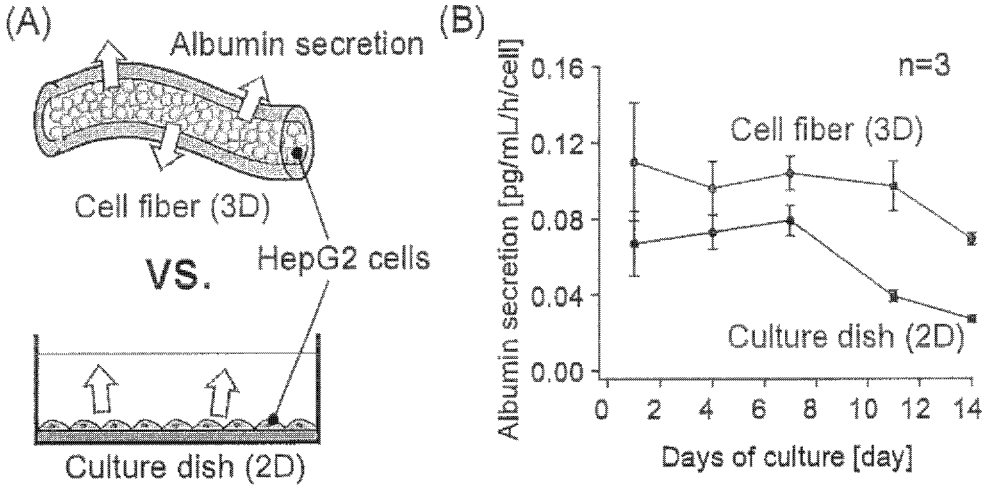
FIG. 29 This figure shows the result of comparison of amount of albumin secreted as a result of culture of a microfiber containing a cell fiber of the HepG2 cells in a core (core: collagen gel, shell: alginate gel) with that secreted by HepG2 cells cultured on a dish.

A microfiber consisting of collagen gel as the core containing the HepG2 cells and the shell of alginate gel was prepared and cultured to obtain a microfiber containing a cell fiber of the HepG2 cell in the core. When amount of albumin secreted from this microfiber by incubation was compared with amount of albumin secreted by the HepG2 cells cultured on a dish, the amount of albumin secreted from the microfiber was higher than the amount observed by the culture on a dish. The results are shown in FIG. 29. It was considered that the HepG2 cells encapsulated in the core were maintained under a three-dimensional optimum environment, and as a result, the cells successfully secreted albumin in a larger amount compared with that observed with the two-dimensional culture condition on a dish.

Example 16

Figure 30:
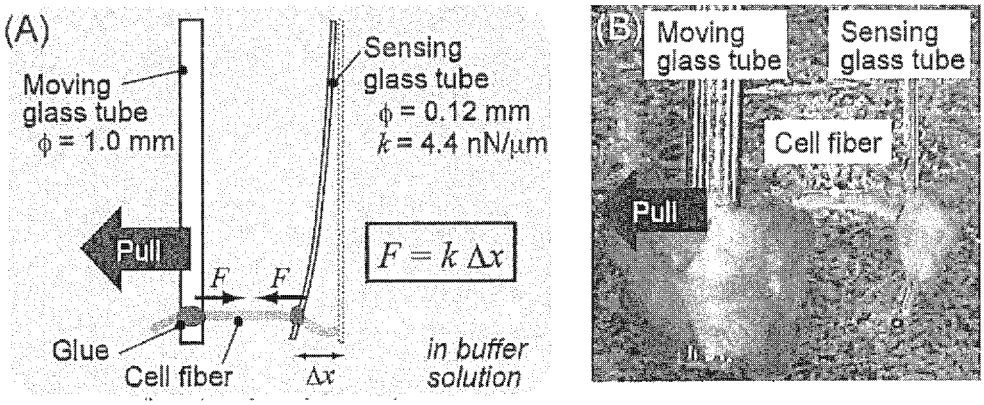
FIG. 30 This figure shows (A) a conceptual sketch of a method for measuring mechanical strength of a microfiber before and after removal of alginate gel from the microfiber, and (B) a state of the measurement. Pressure loaded on the microfibers was calculated by measuring amount of curve of a thin glass tube (diameter: 0.12 mm).
Figure 31:
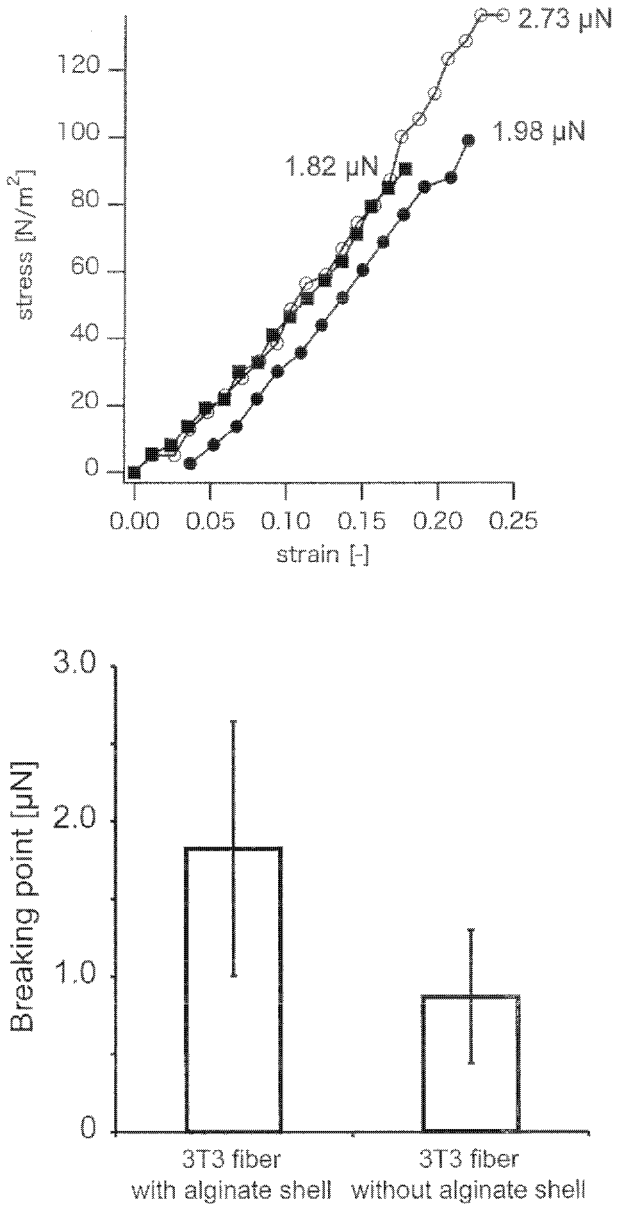
FIG. 31 This figure shows mechanical strength of a microfiber containing a 3T3 cell fiber in the collagen gel of the core before and after removal of a shell (alginate gel) of the microfiber.

A microfiber in which fibrin as an adherent protein was added to collagen gel of the core containing the NIH/3T3 cells and alginate gel of the shell (Type B) was prepared by the method of Example 14 and cultured to obtain a microfiber containing the NIH/3T3 cells in the core. Mechanical strength of this microfiber was measured by the method shown in FIG. 30 before and after removal of alginate gel to confirm the mechanical strength enhancing effect of the alginate gel of the shell. By measuring amount of curve of a thin glass tube (diameter: 0.12 mm) according to the method shown in FIGS. 30, (A) and (B), tension loaded on the microfiber was calculated. The tension loaded when the microfiber broke was considered as mechanical strength. As a result, the microfiber having the shell gave higher mechanical strength compared with the microfiber of which shell was removed (FIG. 31, upper graph and lower graph).

Example 17

Figure 32:
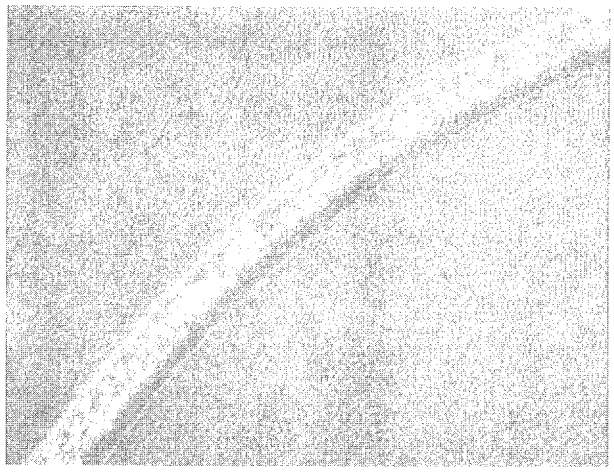
FIG. 32 This figure shows the result of 7-day incubation of a microfiber consisting of collagen gel as a core and alginate gel (1.5%) as a shell wherein neural stem cells were introduced into the core of the microfiber. The upper part shows a state of the microfiber immediately after the preparation thereof, and the lower part shows a state of the same after the culture for seven days.
Figure 32:
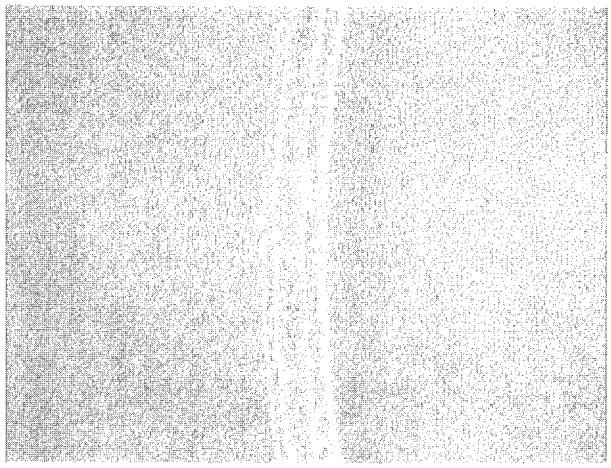

A microfiber consisting of collagen gel as the core and alginate gel (1.5%) as the shell in which neural stem cells were introduced into the core of the microfiber was prepared. To the core, 0.5 μL of EGF, 5 μL of FGF, and 10 μL of B27 were added per 500 μL of collagen, the microfiber was prepared so that the cell density became $6.8\times10^7$ cells/mL, and culture was continued for 7 days by using a medium consisting of 10 mL of Neurobasal A to which 1% antibiotics (penicillin and streptomycin), 2 μL of EGF, 20 μL of FGF, and 200 μL of B27 were added. The results are shown in FIG. 32. The upper photograph shows the microfiber immediately after the fabrication, and the lower photograph shows the microfiber after culture of 7 days. The neural stem cells proliferated in the core of the microfiber, and filled the core.

What is claimed is:

1. A microfiber having a core/shell structure, the microfiber comprising:

a micro gel fiber forming a core of the core/shell structure; and a high strength hydrogel forming a shell of the core/shell structure that covers the micro gel fiber, wherein the micro gel fiber completely occupies an interior volume defined by the shell.

2. The microfiber according to claim 1, wherein the high strength hydrogel is alginate gel or agarose gel.

3. The microfiber according to claim 1, wherein the micro gel fiber is a fiber comprising hydrogel selected from the group consisting of chitosan gel, collagen gel, gelatin, peptide gel, fibrin gel, and a mixture thereof as a base material.

4. The microfiber according to claim 1, wherein the micro gel fiber to be covered has an external diameter in the range of from 100 nm to 1,000 μm, and the micro gel fiber covered with the high strength hydrogel has an external diameter in the range of from 200 nm to 2,000 μm.

5. The microfiber according to claim 1, wherein a cell or cell culture is contained in the micro gel fiber.

6. The microfiber according to claim 5, wherein a growth factor is contained in the micro gel fiber.

7. A structure comprising the microfiber according to claim 1.

8. The structure according to claim 7, which has a woven fabric structure or a helical structure.

9. A cell fiber obtainable by removing a cover of high strength hydrogel from a microfiber containing cell culture in a micro gel fiber, wherein the micro gel fiber comprises a hydrogel selected from the group consisting of chitosan gel, collagen gel, gelatin, peptide gel, and mixtures of the foregoing, or comprises fibrin gel together with a hydrogel selected from the group consisting of chitosan gel, collagen gel, gelatin, peptide gel, and mixtures of the foregoing.

10. A cell structure obtainable by removing cover of high strength hydrogel from a two-dimensional or three-dimensional structure constructed with the microfiber containing cell culture in the micro gel fiber according to claim 9.

* * * * *